US005745021A

United States Patent [19]

Miyoshi et al.

[11] Patent Number: 5,745,021

[45] Date of Patent: Apr. 28, 1998

[54] LINE FILTER

[75] Inventors: Hisayo Miyoshi; Toshinori Oda; Tatsuya Mori; Shunya Inoue; Yutaka Tsutsumi, all of Osaka, Japan

[73] Assignee: Matsushita Electric Industrial Co., Ltd., Osaka, Japan

[21] Appl. No.: 819,180

[22] Filed: Mar. 17, 1997

Related U.S. Application Data

[62] Division of Ser. No. 711,709, Aug. 30, 1996, Pat. No. 5,635,891, which is a continuation of Ser. No. 400,701, Mar. 8, 1995, abandoned, which is a division of Ser. No. 208,780, Mar. 11, 1994, abandoned.

[30] Foreign Application Priority Data

| | | | |
|---|---|---|---|
| Mar. 12, 1993 | [JP] | Japan | 5-51890 |
| Apr. 6, 1993 | [JP] | Japan | 5-79309 |
| Sep. 27, 1993 | [JP] | Japan | 5-239639 |
| Sep. 27, 1993 | [JP] | Japan | 5-239640 |
| Sep. 27, 1993 | [JP] | Japan | 5-239641 |
| Oct. 4, 1993 | [JP] | Japan | 5-247929 |
| Jan. 20, 1994 | [JP] | Japan | 6-4468 |

[51] Int. Cl.[6] ..... H01F 27/30

[52] U.S. Cl. ..... 336/196; 336/198

[58] Field of Search ..... 336/90, 92, 96, 336/196, 197, 198, 208, 210

[56] References Cited

U.S. PATENT DOCUMENTS 714,891 12/1902 Gill ..... 336/212

*Primary Examiner*—Thomas J. Kozma
*Attorney, Agent, or Firm*—Lowe, Price, LeBlanc & Becker

[57] ABSTRACT

A line filter includes a magnetic core having a leg. A bobbin is placed around the leg of the magnetic core. The bobbin has end collars provided with projections respectively. A pair of windings are provided on the bobbin. A molded casing made of resin houses the magnetic core, the bobbin, and the windings. The casing has movable tongues which engage the projections on the bobbin collars to fix the bobbin to the casing. The casing has inner surfaces formed with ribs which engage the magnetic core to fix the magnetic core to the casing. The casing has an L-shaped movable member extending from a ceiling thereof and engaging the magnetic core to fix the magnetic core to the casing.

1 Claim, 25 Drawing Sheets

LINE FILTER

This application is a division of application Ser. No. 08/711,709 filed Aug. 30, 1996, now U.S. Pat. No. 5,635,891 which in turn is a continuation of application Ser. No. 08/400,701 filed Mar. 8, 1995, now abandoned which in turn is a division of Ser. No. 08/208,780, filed on Mar. 11, 1994 now abandoned.

BACKGROUND OF THE INVENTION

1. Field of the Invention

This invention generally relates to an inductive device including a winding on a magnetic core. This invention specifically relates to a line filter provided in, for example, a power supply circuit of an electronic apparatus to prevent entrance and leakage of noise into and from the electronic apparatus via a power supply line.

2. Description of the Prior Art

A typical prior-art line filter is used to damp or suppress common-mode noise (generally, radio-frequency noise) which occurs between a power supply line and a ground. The line filter includes a pair of windings on a magnetic core. The filter windings are disposed in a pair of line segments of the power supply line respectively. A line current passing through the filter windings causes magnetic flux. The magnetic core has such a configuration as to form a closed magnetic circuit for the magnetic flux. To prevent the magnetic core from being magnetically saturated. The combination of the magnetic core and the filter windings is designed so that the magnetic flux generated by one of the windings can cancel the magnetic flux generated by the other winding.

A first example of such a prior-art line filter includes a magnetic core with a single opening, and a bobbin made of resin which is positioned around one leg of the magnetic core. A pair of windings are provided on the bobbin. The bobbin is formed with a gear. During assembly of the line filter, the bobbin is rotatably supported on the leg of the magnetic core, and ends of wires are connected to the bobbin. A suitable drive mechanism is set into engagement with the gear on the bobbin. As the bobbin is rotated relative to the magnetic core by the drive mechanism, the wires are automatically wound on the bobbin to provide the filter windings. After the filter windings have been completed, the bobbin and the magnetic core are bonded together by adhesive.

The adhesive tends to apply a stress to the magnetic core. Such a stress causes a reduction of inductances of the filter windings by 5–30% as the line filter ages.

A second example of the prior-art Line filter includes a magnetic core with two openings, and a bobbin made of resin which is positioned around a central leg of the magnetic core. A pair of windings are provided on the bobbin. The bobbin is formed with a gear. The second example of the prior-art line filter is assembled similarly to the assembly of the first example of the prior-art Line filter.

SUMMARY OF THE INVENTION

It is an object of this invention to provide an improved line filter.

A first aspect of this invention provides a line filter comprising a magnetic core having a leg; a bobbin placed around the leg of the magnetic core and having end collars provided with projections respectively; a pair of windings provided on the bobbin; and a molded casing made of resin and housing the magnetic core, the bobbin, and the windings: wherein the casing has movable tongues which engage the projections on the bobbin collars to fix the bobbin to the casing, and the casing has inner surfaces formed with ribs which engage the magnetic core to fix the magnetic core to the casing, and wherein the casing has an L-shaped movable member extending from a ceiling thereof and engaging the magnetic core to fix the magnetic core to the casing.

A second aspect of this invention provides a line filter comprising a magnetic core having a leg; a bobbin placed around the leg of the magnetic core and having end collars: metal terminals provided on the end collars of the bobbin; a pair of windings provided on the bobbin and having ends connected to the metal terminals respectively; a molded casing made of resin and housing the magnetic core, the bobbin, and the windings, the casing having ribs which engage the bobbin to fix the bobbin to the casing; and mounting pins provided on the ribs and projecting from the casing.

A third aspect of this invention provides a line filter comprising a magnetic core having a leg; a bobbin placed around the leg of the magnetic core; a pair of windings provided on the bobbin; and a casing which houses the magnetic core, the bobbin, and the windings, the casing having radiating apertures located above the windings to facilitate escape of heat from the bobbin through the casing.

A fourth aspect of this invention provides a line filter comprising a magnetic core having a leg; a bobbin placed around the leg of the magnetic core and having end collars provided with first projections and second projections; a pair of windings provided on the bobbin; and a casing which houses the magnetic core, the bobbin, and the windings, the casing having apertures into which the first projections on the end collars of the bobbin fit; wherein the second projections on the end collars of the bobbin extend downward and have lowermost fiat surfaces flush with lowermost surfaces of the casing.

A fifth aspect of this invention provides a line filter comprising a magnetic core having a leg; a bobbin placed around the leg of the magnetic core and having end collars, intermediate collars, and R portions extending along bases of the intermediate collars to reinforce the intermediate collars, the end collars being provided with projections and holes. The end collars being further provided with taper portions located between the projections and ends of the holes, the intermediate collars being provided with grooves; metal terminals fitting into the holes in the end collars of the bobbin; and a pair of windings provided on the bobbin and having ends which are supported on the intermediate collars at the grooves thereof and are connected to the metal terminals.

A sixth aspect of this invention provides a line triter comprising a magnetic core having a leg; a bobbin placed around the leg of the magnetic core and having a gear; a pair of windings provided on the bobbin; and a band engaging the gear and the magnetic core to fix the gear and the magnetic core to each other.

A seventh aspect of this invention provides a line filter comprising a magnetic core having a leg; a bobbin placed around the leg of the magnetic core and having end collars, wherein outer end faces of the end collars have grooves; a pair of windings provided on the bobbin; and a retainer holding the magnetic core and having portions fitting into the groove in the end collars of the bobbin so that the retainer is fixed to the bobbin.

An eighth aspect of this invention provides a line filter comprising a magnetic core having a rectangular configuration with a single opening, the magnetic core having first and second opposing legs and first and second opposing yokes connecting the first and second legs, the first and second legs and the first and second yokes being integral with each other, wherein the first leg and the first and second yokes have thicknesses greater than a thickness of the second leg and the first and second legs and the first and second yokes have cross-sectional areas approximately equal to each other: a bobbin placed around the second leg of the magnetic core; and a pair of windings provided on the bobbin.

A ninth aspect of this invention provides a line filter comprising a magnetic core being of a shape of a character "日" and having a central leg, two side legs, and two yokes connecting the central and side legs, the central and side legs and the yokes being integral with each other, wherein the side legs and the yokes have thicknesses greater than a thickness of the central leg, and the side legs and the yokes have cross-sectional areas approximately equal to a half of a cross-sectional area of the central leg; a bobbin placed around the central leg of the magnetic core; and a pair of windings provided on the bobbin.

A tenth aspect of this invention provides an inductive device comprising a magnetic core having first and second portions; a bobbin extending around the first portion of the magnetic core and having a step; a winding extending on the bobbin; and a casing which houses the magnetic core, the bobbin, and the winding, wherein the casing has a step engaging the step of the bobbin to fix the bobbin to the casing and the casing has a projecting engagement portion which engages the second portion of the magnetic core to fix the magnetic core to the casing.

DESCRIPTION OF THE FIRST PREFERRED EMBODIMENT

Figure 1:
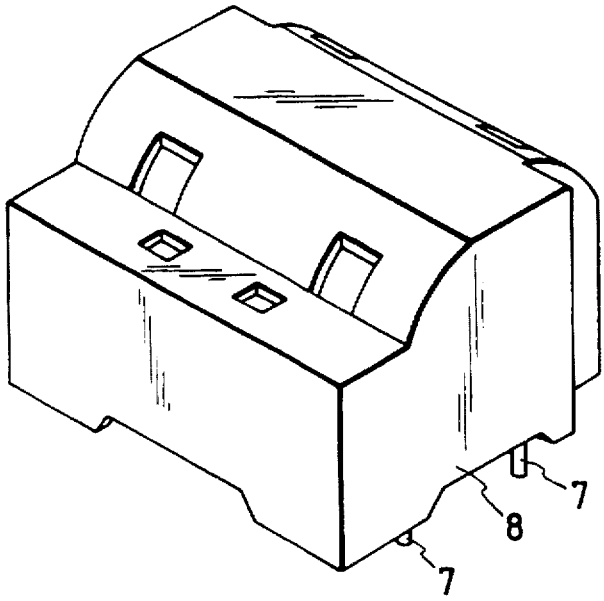
FIG. 1 is a perspective view of a line filter according to a first embodiment of this invention.

As shown in FIG. 1. a line filter includes a molded casing 8 made of resin. The casing 8 has a bottom opening and an inner space in which a magnetic core, a bobbin, and filter windings are fixedly disposed as will be described later.

Figure 2:
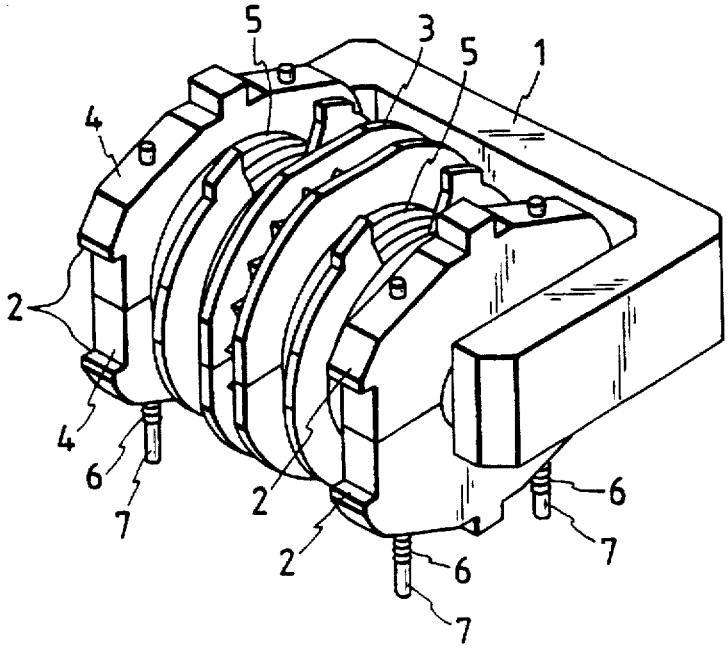
FIG. 2 is a perspective view of a magnetic core, a bobbin, and filter windings in the line filter of FIG. 1.

As shown in FIG. 2. a magnetic core 1 has a rectangular closed-loop configuration with a single opening. The core 1 is made of high-permeability magnetic material such as ferrite. A cylindrical bobbin 4 is positioned around one leg of the magnetic core 1. The bobbin 4 has end collars each formed with projections 2, the total number of which is in the range of two to six. The projections 2 provide steps or shoulders respectively. An end portion or a central portion of the bobbin 4 is provided with a gear 3.

The bobbin 4 is divided into two semicylindrical molded halves made of resin. During assembly of the line filter, separate bobbin halves are placed around one leg of the magnetic core 1 and are then combined into a cylindrical bobbin rotatable about the leg of the magnetic core 1. The bobbin halves have engagement portions fittable to each other. When the bobbin halves are combined, the engagement portions of the bobbin halves are fitted to each other so that the bobbin halves can be secured to each other.

The bobbin 4 has two grooves for accommodating windings. During assembly of the line filter, ends of copper wires covered with insulating films are connected to the bobbin 4. Then, a suitable drive mechanism (not shown) is set into engagement with the gear 3 on the bobbin 4. As the bobbin 4 is rotated relative to the magnetic core 1 by the drive mechanism, the wires are automatically wound on the bobbin in equal circumferential directions to form two filter windings 5. The end collars of the bobbin 4 have holes extending therethrough. After the wires have been successfully wound on the bobbin 4, metal terminals 7 are fitted into the respective holes in the bobbin collars so that the metal terminals 7 are secured to the bobbin 4. Opposite ends 6 of the wires are wound on the metal terminals 7 respectively, and are mechanically and electrically connected to the metal terminals 7 by, for example, solder.

The filter windings 5, the metal terminals 7, and the connections therebetween may also be prodded as follows. Before the execution of a process of winding the copper wires on the bobbin 4, the metal terminals 7 are inserted into the respective holes in the bobbin collars to an extent such that portions of the metal terminals 7 which emerge from outer surfaces of the bobbin collars will not interfere with rotation of the bobbin 4 relative to the magnetic core 1. Then, the process of winding the copper wires on the bobbin 4 to form the filter windings 5 is executed while the bobbin 4 is rotated relative to the magnetic core 1. After the wires have been successfully wound on the bobbin 4, the metal terminals 7 are shifted relative to the bobbin collars by a desired distance. Subsequently, opposite ends 6 of the wires are wound on the metal terminals 7 respectively, and are mechanically and electrically connected to the metal terminals 7 by, for example, solder.

During assembly of the line filter, the combination of the magnetic core 1. The bobbin 4, the filter windings 5, and the metal terminals 7 is placed into the casing 8 via the bottom opening thereof.

Figure 3:
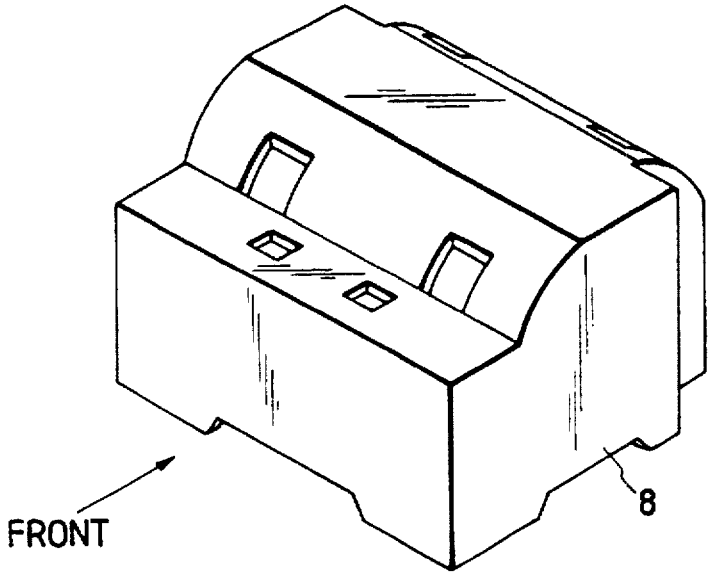
FIG. 3 is a perspective front side view of a casing in the line filter of FIG. 1.
Figure 4:
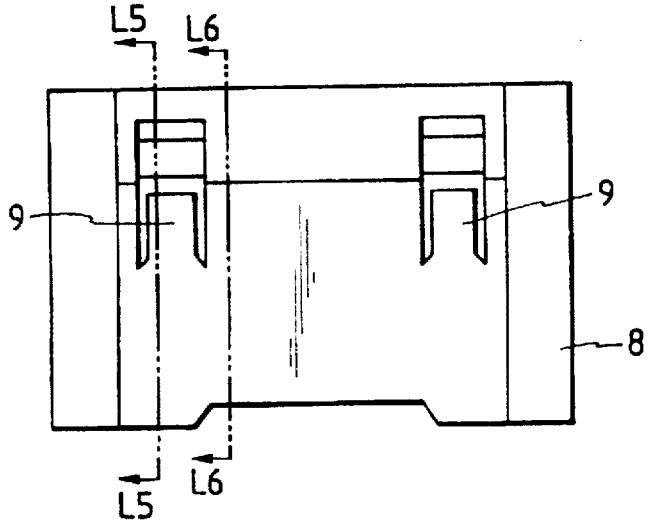
FIG. 4 is a rear view of the casing of FIG. 3.
Figure 5:
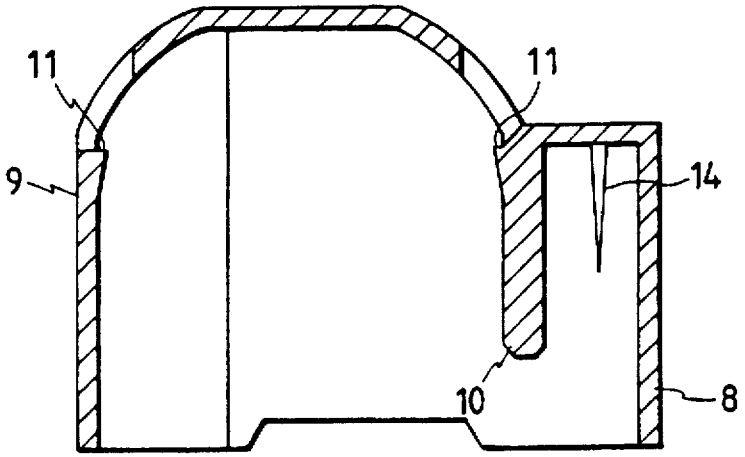
FIG. 5 is a sectional view of the casing taken along the line L5—L5 in FIG. 4.

A detailed description will now be given of the casing 8 with reference to FIGS. 3–6. As shown in FIG. 3, the casing 8 is of a horizontal type, having a horizontal dimension significantly greater than a vertical dimension thereof. As shown in FIGS. 4 and 5, a back side of the casing 8 has two U-shaped apertures providing deformable or movable tongues 9 horizontally spaced from each other by a predetermined distance. The tongues 9 have a horizontal width of about 2–5 mm. As shown in FIG. 5, two deformable or movable tongues 10 extend downward from ceiling walls of the casing 8. The positions of the tongues 9 and the positions of the tongues 10 are approximately symmetrical with respect to the center of the interior of the casing 8.

The distance between the tongues 9 and the corresponding tongues 10 is equal to or slightly greater than the distance between the projections 2 on the bobbin collars. Upper ends of the tongues 9 and the tongues 10 have taper portions 11. A horizontal linear region of each of the taper portions 11 projects inward by an increasing degree as the region moves upward. The thickness of each of the taper portions 11 varies in the range of about 0.2–1.0 mm. The taper portions 11 are designed to be fittable to or engageable with the projections 2 on the bobbin collars. Upper regions of the raper portions 11 provide steps or shoulders engageable with the steps on the bobbin collar projections 2.

Figure 6:
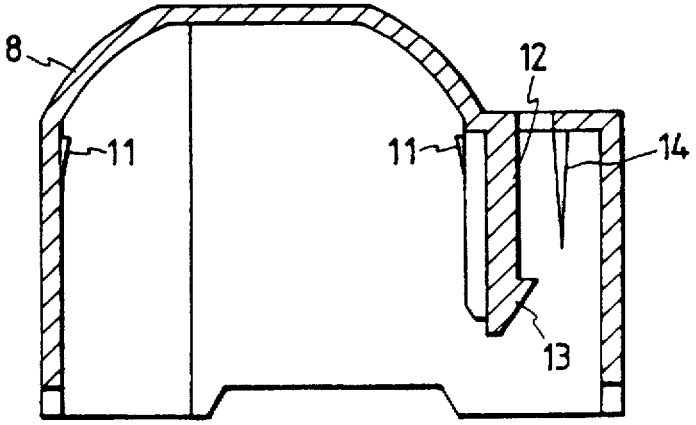
FIG. 6 is a sectional view of the casing taken along the line L6—L6 in FIG. 4.

As shown in FIG. 6, two deform able or movable L-shaped tongues 12 extend downward from the ceiling walls of the casing 8. As will be described later. The L-shaped tongues 12 serve to fix the magnetic core 1 to the casing 8. The vertical distance between the inner surface of the ceiling walls of the casing 8 and a bent portion of each of the L-shaped tongues 12 is equal to or slightly greater than the thickness of a leg of the magnetic core 1. The inner surfaces of right-hand and left-hand sides of the casing 8 are formed with vertically-extending thin ribs 14 of a triangular shape which are located at symmetrical positions. The total number of the ribs 14 is in the range of two to six. The distance between ends of the opposing ribs 14 is slightly smaller than the dimension of the leg of the magnetic core 1. It is preferable that a similar rib or ribs 14 are provided on the inner surfaces of a front side of the casing 8.

Figure 7:
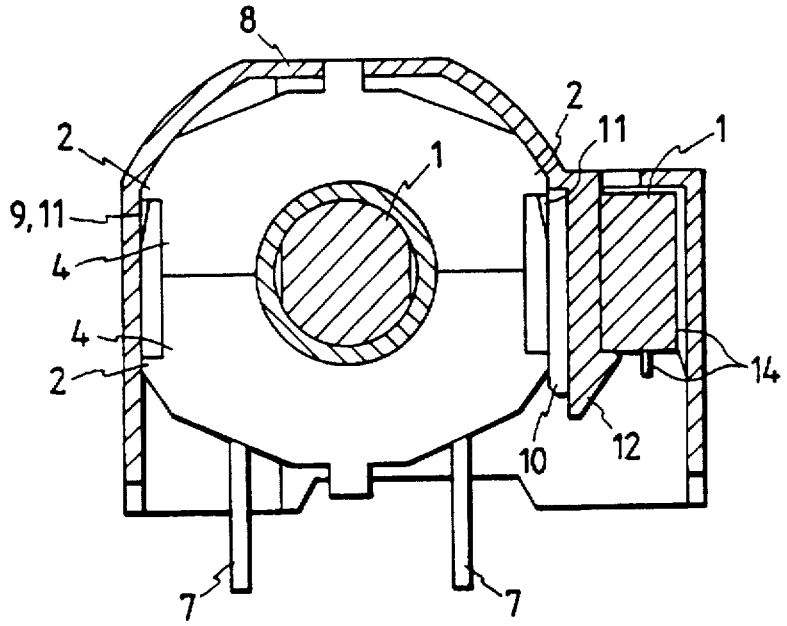
FIG. 7 is a sectional view of the line filter of FIG. 1.
Figure 8:
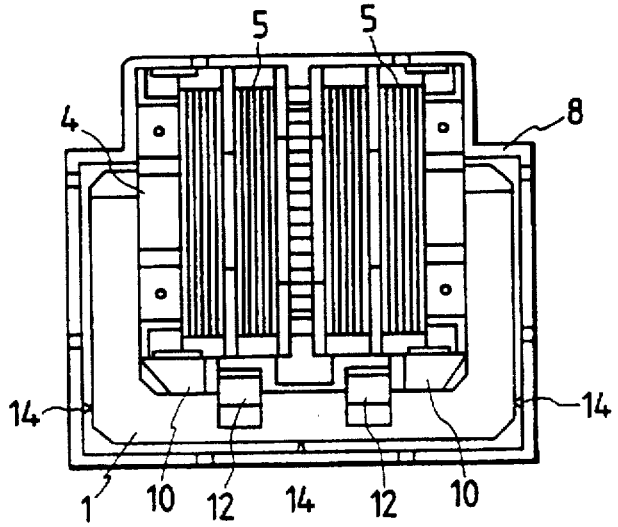
FIG. 8 is a bottom view of the line filter of FIG. 1.

During assembly of the line filter, the combination of the magnetic core 1, the bobbin 4, the filter windings 5, and the metal terminals 7 is placed into the casing 8 via the bottom opening thereof as shown in FIGS. 7 and 8. During movement of the combination into the casing 8, the bobbin 4 is guided along the back side walls of the casing 8 and the tongues 10. As the combination is placed into the casing 8, upper projections 2 on the end collars of the bobbin 4 force the taper portions 11 of the tongues 9 and 10 outward. When the upper projections 2 on the bobbin collars move beyond the taper portions 11 of the tongues 9 and 10, the taper portions 11 return inward and fall into recesses extending immediately below the upper projections 2. As a result, the steps on the upper bobbin collar projections 2 engage the steps on the taper portions 11 of the tongues 9 and 10, and an upper portion of the bobbin 4 is fixedly held among the taper portions 11 of the tongues 9 and 10 and the ceiling walls of the casing 8.

During movement of the combination into the casing 8, a leg of the magnetic core 1 forces the L-shaped tongues 12 toward the center of the interior of the casing 8 and advances into a space between the tongues 12 and the front side walls of the casing 8. As the leg of the magnetic core 1 advances in the space between the tongues 12 and the front side walls of the casing 8, the leg of the magnetic core 1 slightly shaves away the ribs 14 on the inner surfaces of the casing 8. When the leg of the magnetic core 1 moves beyond the bent portions of the tongues 12, the tongues 12 return so that the bent portions of the tongues 12 engage a lower end of the leg of the magnetic core 1. Thus, the leg of the magnetic core is fixedly held among the L-shaped tongues 12, the ribs 14 on the casing 8, and the ceiling walls of the casing 8.

In this way, the combination of the magnetic core 1, the bobbin 4, the filter windings 5, and the metal terminals 7 is placed and fitted into the casing 8. In addition, the combination is automatically fixed to the casing 8.

As is made dear from the previous description, the line filter does not use adhesive for bonding the magnetic core 1 and the bobbin 4 together. Therefore, it is possible to prevent the occurrence of a problem caused by such adhesive.

Figure 59:
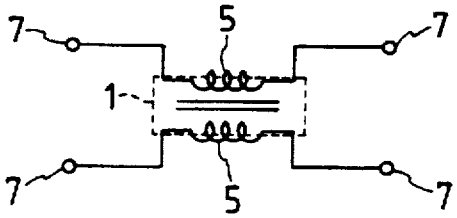
FIG. 59 is a schematic diagram of the line filter of FIG. 1.

As shown in FIG. 59, one of the filter windings 5 provided on the magnetic core 1 is electrically connected between a first pair of the metal terminals 7, and the other filter winding 5 is electrically connected between a second pair of the metal terminals 7. In general, the first pair of the metal terminals 7 are disposed in one of two line segments of a power supply line, and the second pair of the metal terminals 7 are disposed in the other line segment of the power supply line.

This embodiment may be modified as follows. A first modification of this embodiment uses a magnetic core of a shape of a character "ㅁ" which has a central leg and two side legs. In the first modification of this embodiment, the bobbin 4 is provided on the central leg of the magnetic core.

In a second modification of this embodiment, a casing 8 is made of electromagnetic shielding material such as a mixture of resin and magnetic power. In this case, the casing 8 blocks entrance and leakage of electromagnetic wave noise into and from the filter windings 5 and the magnetic core 1. An example of the magnetic powder is ferrite powder.

DESCRIPTION OF THE SECOND PREFERRED EMBODIMENT

Figure 13:
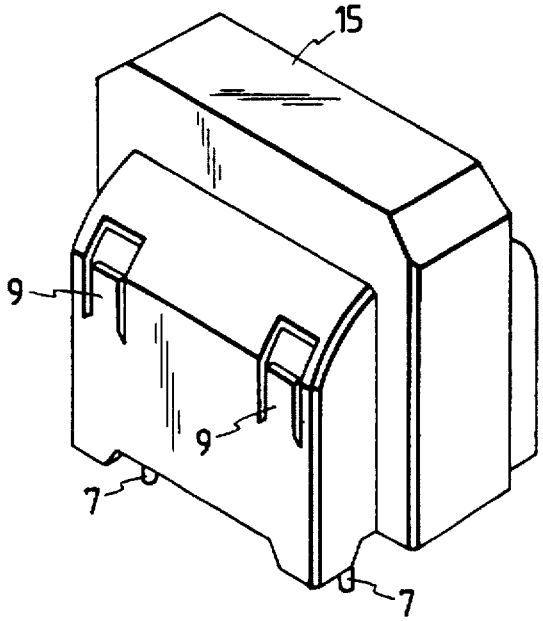
FIG. 13 is a perspective view of the line filter of the second embodiment.

As shown in FIG. 13, a line filter includes a molded casing 15 made of resin. The casing 15 has a bottom opening and an inner space in which a magnetic core, a bobbin, and filter windings are fixedly disposed as will be described later. The magnetic core, the bobbin, and the filter windings are similar to those of the embodiment of FIGS. 1–8 and 59.

Figure 9:
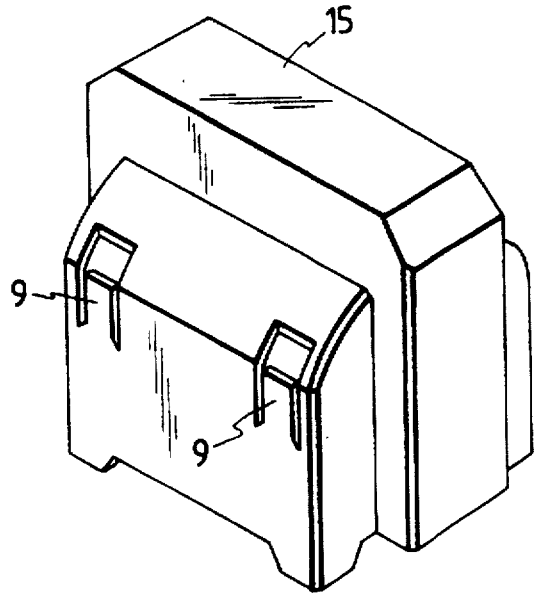
FIG. 9 is a perspective view of a casing in a line filter according to a second embodiment of this invention.
Figure 10:
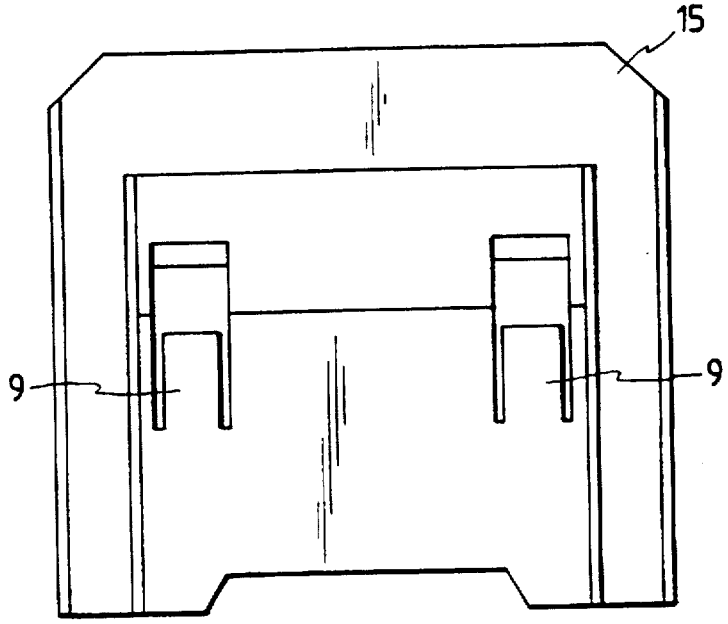
FIG. 10 is a front view of the casing of FIG. 9.
Figure 11:
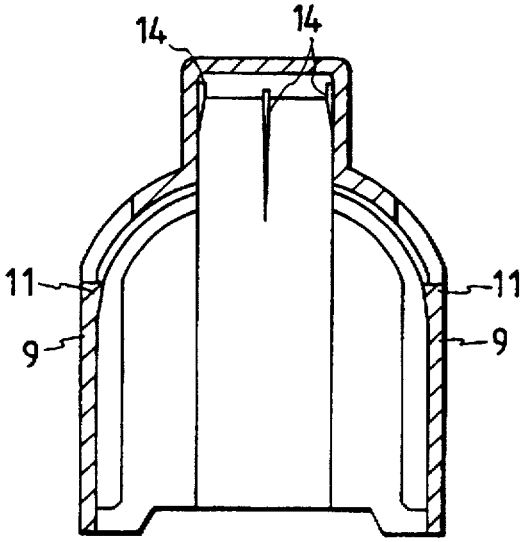
FIG. 11 is a sectional view of the casing of FIG. 9.

As shown in FIGS. 9 and 10, the casing 15 is of a vertical type, having a vertical dimension significantly greater than a horizontal dimension thereof. As shown in FIGS. 9–11, each of front and back sides of the casing 15 has two U-shaped apertures providing deformable or movable tongues 9 horizontally spaced from each other by a predetermined distance. The tongues 9 have a horizontal width of about 2–5 min. As shown in FIG. 5, two deformable or movable tongues 10 extend downward from ceiling walls of the casing 15. The positions of the tongues 9 on the front side of the casing 15 and the positions of the tongues 9 on the back side of the casing 15 are approximately symmetrical with respect to the center of the interior of the casing 15.

The distance between the tongues 9 on the front side of the casing 15 and the corresponding tongues 9 on the back side of the casing 15 is equal to or slightly greater than the distance between the projections 2 on the bobbin collars. Upper ends of the tongues 9 have taper portions 11. A horizontal linear region of each of the taper portions 11 projects inward by an increasing degree as the region moves upward. The thickness of each of the taper portions 11 varies m the range of about 0.2–1.0 mm. The taper portions 11 are designed to be fittable to or engageable with the projections 2 on the bobbin collars. Upper regions of the taper portions 11 provide steps or shoulders engageable with the steps on the bobbin collar projections 2.

An uppermost portion of the interior of the casing 15 is designed to accommodate a leg of the magnetic core 1. Specifically, the uppermost portion of the interior of the casing 15 has a shape slightly greater than the shape of the leg of the magnetic core 1. As shown in FIG. 11, the inner surfaces of the casing 15 which define the uppermost portion of the interior thereof are formed with vertically-extending thin ribs 14 of a triangular shape. The ribs 14 are located at symmetrical positions. The total number of the ribs 14 is in the range of four to six. The distance between ends of the opposite ribs 14 is slightly smaller than the dimension of the leg of the magnetic core 1.

Figure 12:
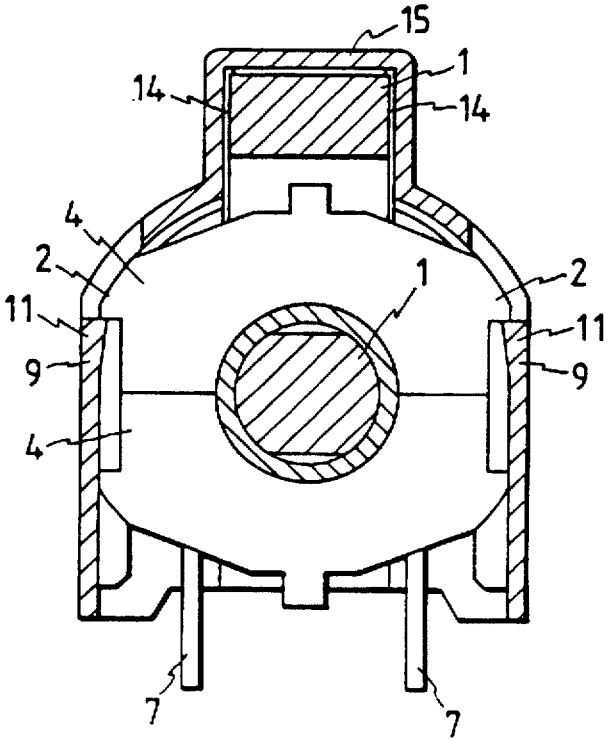
FIG. 12 is a sectional view of the line filter of the second embodiment.

During assembly of the line filter, the magnetic core 1, the bobbin 4, the filter windings 5, and the metal terminals 7 are combined as in the embodiment of FIGS. 1–8 and 59. It should be noted that, as shown in FIG. 12, the angular position of the magnetic core 1 relative to the bobbin 4 and the metal terminals 7 is changed from that in the embodiment of FIGS. 1-8 and 59. The combination of the magnetic core 1, the bobbin 4, the filter windings 5, and the metal terminals 7 is placed into the casing 15 via the bottom opening thereof as shown in FIG. 12. During movement of the combination into the casing 15, the bobbin 4 is guided along the front and back side walls of the casing 15. As the combination is placed into the casing 15, upper projections 2 on the end collars of the bobbin 4 force the taper portions 11 of the tongues 9 outward. When the upper projections 2 on the bobbin collars move beyond the taper portions 11 of the tongues 9, the taper portions 11 return inward and fall into recesses extending immediately below the upper projections 2. As a result, the steps on the upper bobbin collar projections 2 engage the steps on the taper portions 11 of the tongues 9, and an upper portion of the bobbin 4 is fixedly held among the taper portions 11 of the tongues 9 and inclined front and back side walls of the casing 15.

During movement of the combination into the casing 15, a leg of the magnetic core 1 advances into the uppermost portion of the interior of the casing 15. As the leg of the magnetic core 1 advances in the uppermost portion of the interior of the casing 15, the leg of the magnetic core 1 slightly shaves away the ribs 14 on the inner surfaces of the casing 15. Finally, the leg of the magnetic core 1 is positioned in the uppermost portion of the interior of the casing 15 while being fixedly held among the ribs 14 on the casing 15.

In this way, the combination of the magnetic core 1, the bobbin 4, the filter windings 5, and the metal terminals 7 is placed and fitted into the casing 15. In addition, the combination is automatically fixed to the casing 15.

As is made clear from the previous description, the line filter does not use adhesive for bonding the magnetic core 1 and the bobbin 4 together. Therefore, it is possible to prevent the occurrence of a problem caused by such adhesive.

This embodiment may be modified as follows. A first modification of this embodiment uses a magnetic core of a shape of a character "□" which has a central leg and two side legs. In tile first modification of this embodiment, the bobbin 4 is provided on the central leg of the magnetic core.

In a second modification of this embodiment, a casing 15 is made of electromagnetic shielding material such as a mixture of resin and magnetic power. In this case, the casing 15 blocks entrance and leakage of electromagnetic wave noise into and from the filter windings 5 and the magnetic core 1. An example of the magnetic powder is ferrite powder.

DESCRIPTION OF THE THIRD PREFERRED EMBODIMENT

Figure 14:
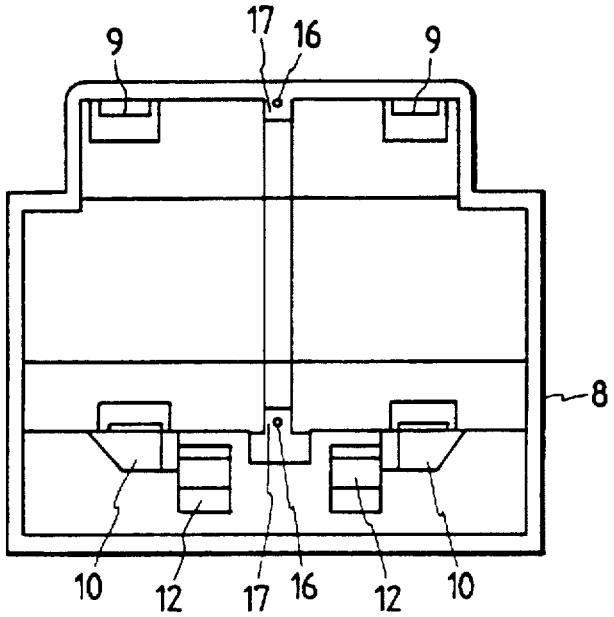
FIG. 14 is a bottom view of a casing in a line filter according to a third embodiment of this invention.

A third embodiment of this invention is similar to the embodiment of FIGS. 1–8 and 59 except for design changes indicated hereinafter. In the third embodiment, as shown in FIG. 14, a casing 8 of a line filter has a pair of opposing ribs 17. The ribs 17 have a width approximately equal to the distance between end collars of a gear 3 of a bobbin 4 (see FIG. 2). Mounting pins 16 made of metal extend into the walls of the ribs 17 on the casing 8 so that they are fixed to the casing 8. The mounting pins 16 project downward from the casing 8. It is preferable that the mounting pins 16 are inserted into the ribs 17 on the casing 8 before assembly of the line filter.

During assembly of the line filter, the combination of a magnetic core 1, the bobbin 4, filter windings 5, and metal terminals 7 (see FIG. 2) is placed into the casing 8 via a bottom opening thereof. During movement of the combination into the casing 8, the ribs 17 on the casing 8 fit into a region between the end collars of the gear 3 on the bobbin 4 while the gear 3 is guided by the ribs 17. After assembly of the line filter has been completed, the ribs 17 on the casing 8 hold the bobbin 4 so that the bobbin 4 can be more rigidly fixed to the casing 8. The line filter can be attached to a circuit board or others via the mounting pins 16 and the metal terminals 7 (see FIG. 2).

The mounting pins 16 may be inserted into the ribs 17 on the casing 8 after movement of the magnetic core 1, the bobbin 4, the filter windings 5, and the metal terminals 7 into the casing 8 has been completed. The mounting pins 16 may be omitted.

DESCRIPTION OF THE FOURTH PREFERRED EMBODIMENT

Figure 15:
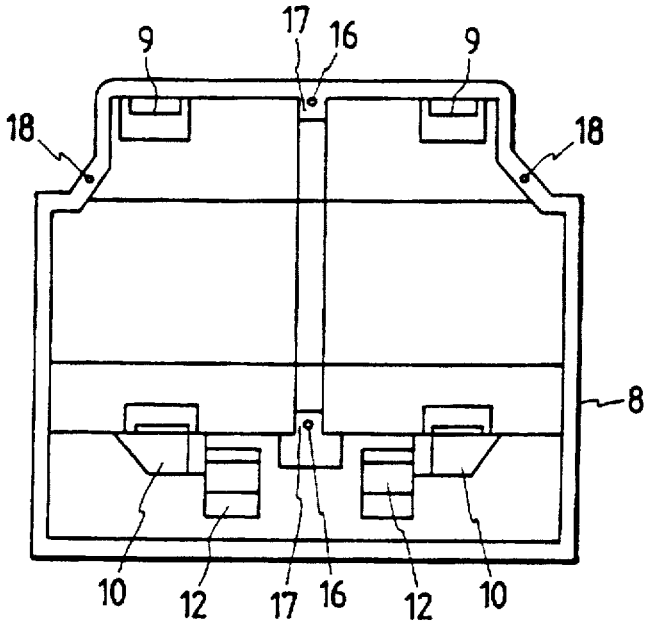
FIG. 15 is a bottom view of a casing in a line filter according to a fourth embodiment of this invention.

A fourth embodiment of this invention is similar to the embodiment of FIG. 14 except for design changes indicated hereinafter. In the fourth embodiment, as shown in FIG. 15, additional mounting pins 18 made of metal extend into the wails of a casing 8 of a line filter so that they are fixed to the casing 8. The mounting pins 18 project downward from the casing 8. The line filter can be attached to a circuit board or others via mounting pins 16, the mounting pins 18, and metal terminals 7 (see FIG. 2).

DESCRIPTION OF THE FIFTH PREFERRED EMBODIMENT

Figure 16:
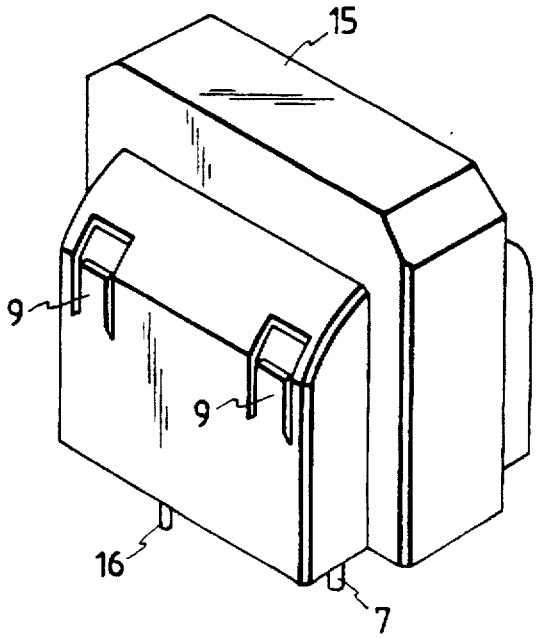
FIG. 16 is a perspective view of a line filter according to a fifth embodiment of this invention.
Figure 17:
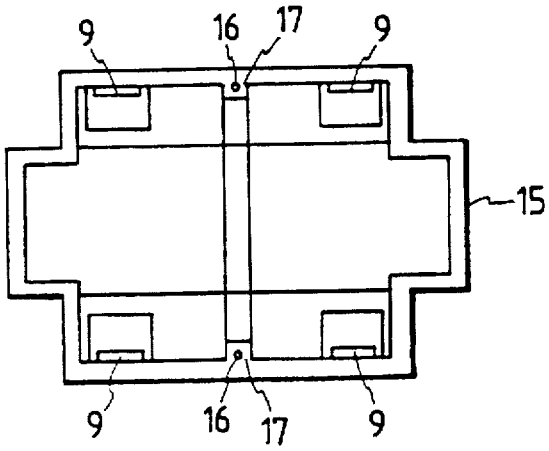
FIG. 17 is a bottom view of a casing in the line filter of FIG. 16.
Figure 18:
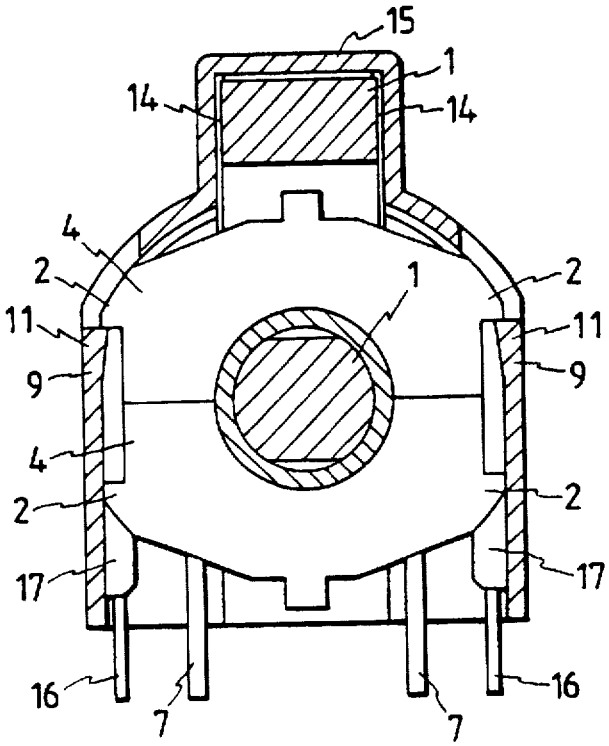
FIG. 18 is a sectional view of the line filter of FIG. 16.

A fifth embodiment of this invention is similar to the embodiment of FIGS. 9–13 except for design changes indicated hereinafter. In the fifth embodiment, as shown in FIGS. 16–18, a casing 15 of a line filter has a pair of opposing ribs 17. The ribs 17 have a width approximately equal to the distance between end collars of a gear 3 of a bobbin 4 (see FIG. 2). Mounting pins 16 made of metal extend into the walls of the ribs 17 on the casing 15 so that they are fixed to the casing 15. The mounting pins 16 project downward from the casing 15. It is preferable that the mounting pins 16 are inserted into the ribs 17 on the casing 15 before assembly of the assembly of the line filter.

During assembly of the line filter, the combination of a magnetic core 1, the bobbin 4, filter windings 5, and metal terminals 7 (see FIG. 2) is placed into the casing 15 via a bottom opening thereof. During movement of the combination into the casing 15, the ribs 17 on the casing 15 fit into a region between the end collars of the gear 3 on the bobbin 4 while the gear 3 is guided by the ribs 17. After assembly of the line filter has been completed, the ribs 17 on the casing 15 hold the bobbin 4 so that the bobbin 4 can be more rigidly fixed to the casing 15. The line filter can be attached to a circuit board or others via the mounting pins 16 and the metal terminals 7 (see FIG. 2).

The mounting pins 16 may be inserted into the ribs 17 on the casing 15 after movement of the magnetic core 1, the bobbin 4, the filter windings 5, and the metal terminals 7 into the casing 15 has been completed. The mounting pins 16 may be omitted.

DESCRIPTION OF THE SIXTH PREFERRED EMBODIMENT

Figure 19:
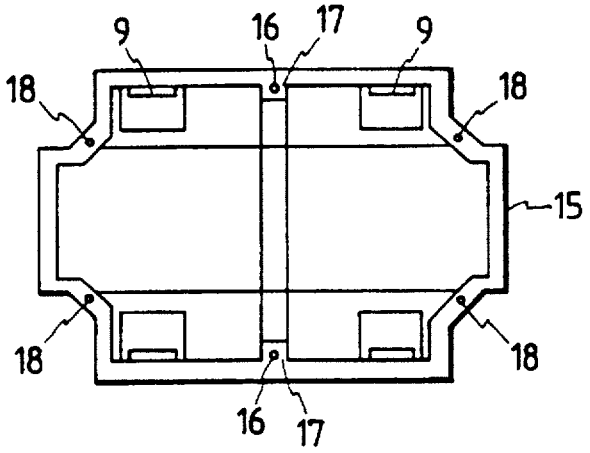
FIG. 19 is a bottom view of a casing in a line filter according to a sixth embodiment of this invention.

A sixth embodiment of this invention is similar to the embodiment of FIGS. 16–18 except for design changes indicated hereinafter. In the sixth embodiment, as shown in FIG. 19, additional mounting pins 18 made of metal extend into the walls of a casing 15 of a line filter so that they are fixed to the casing 15. The mounting pins 18 project downward from the casing 15. The line filter can be attached to a circuit board or others via mounting pins 16, the mounting pins 18, and metal terminals 7 (see FIG. 2).

DESCRIPTION OF THE SEVENTH PREFERRED EMBODIMENT

Figure 20:
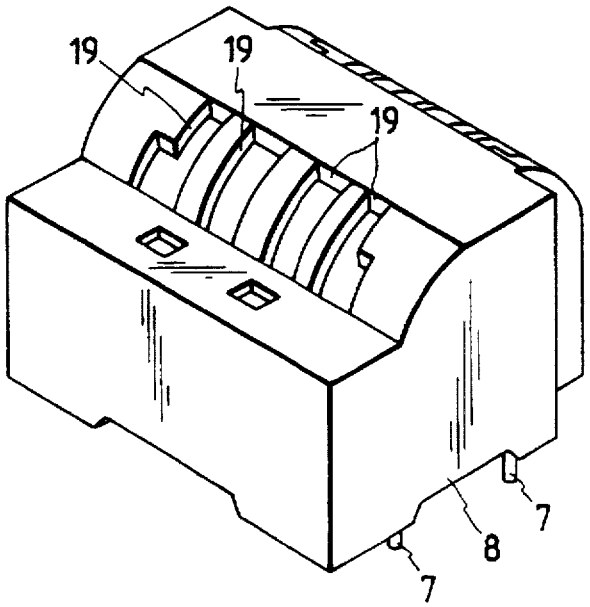
FIG. 20 is a perspective view of a line filter according to a seventh embodiment of this invention.
Figure 21:
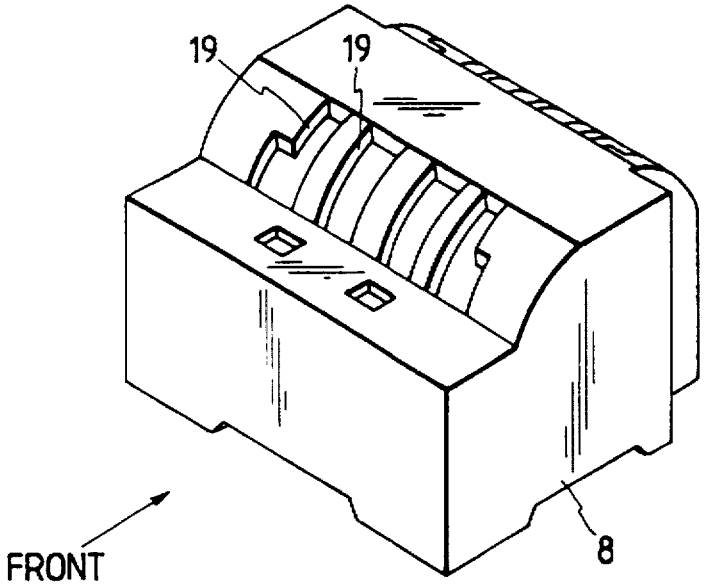
FIG. 21 is a perspective view of a casing in the line filter of FIG. 20.
Figure 22:
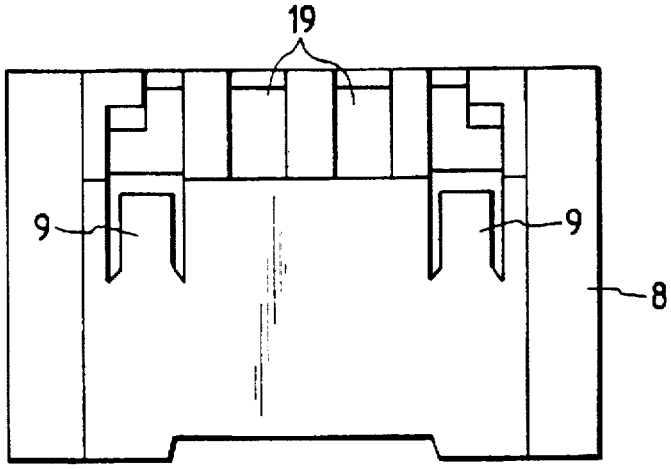
FIG. 22 is a rear view of the casing of FIG. 21.
Figure 23:
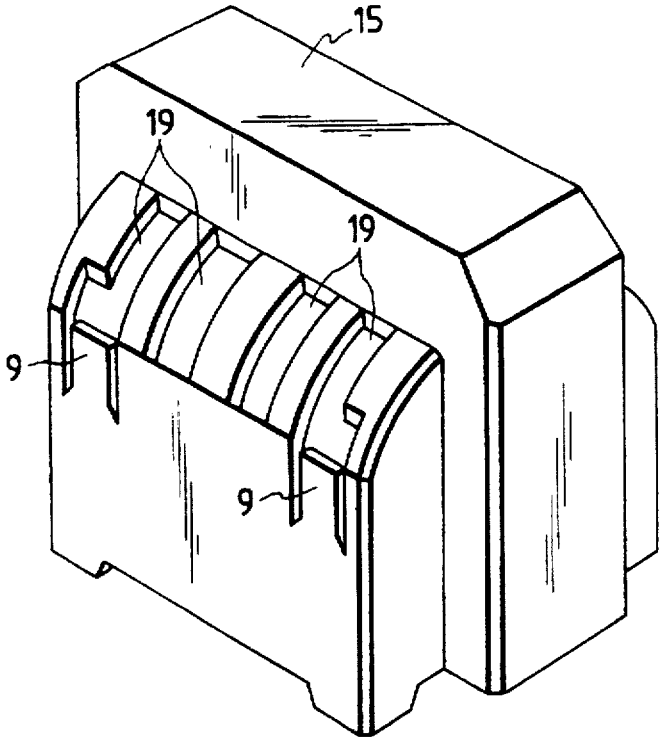
FIG. 23 is a perspective view of a casing in a line filter according to an eighth embodiment of this invention.
Figure 24:
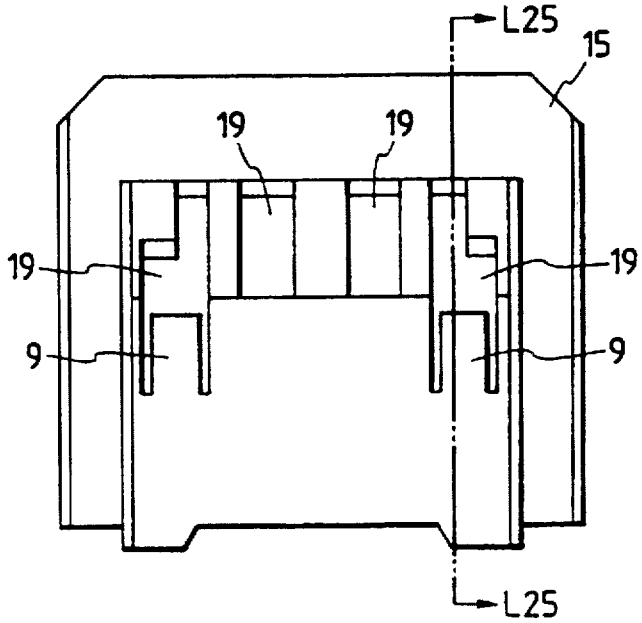
FIG. 24 is a front view of the casing of FIG. 23.
Figure 25:
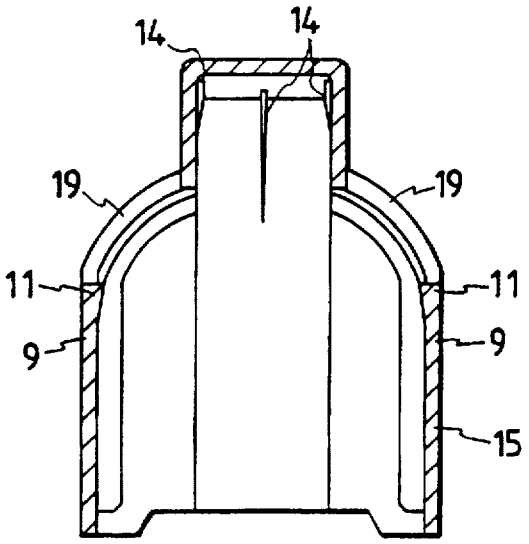
FIG. 25 is a sectional view of the casing taken along the line L25—L25 in FIG. 24.
Figure 26:
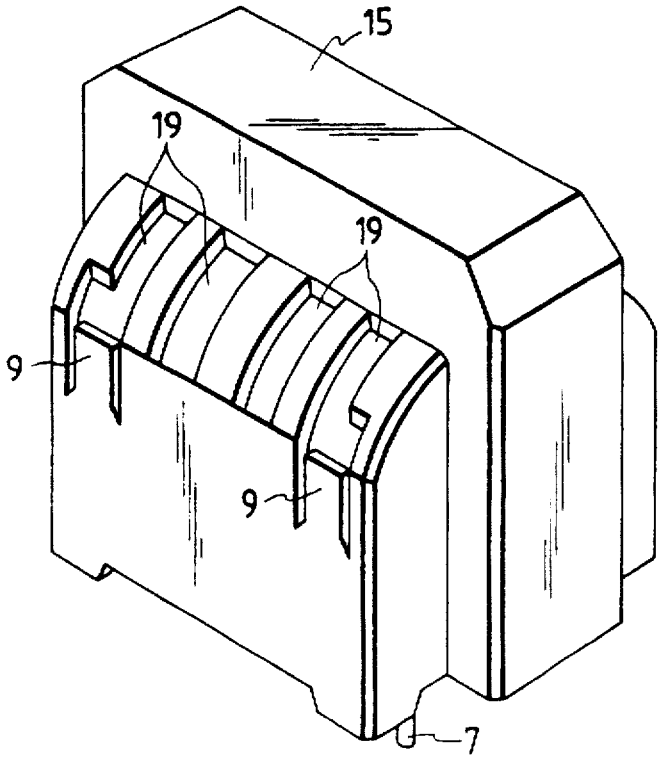
FIG. 26 is a perspective view of the line filter of the eighth embodiment.
Figure 27:
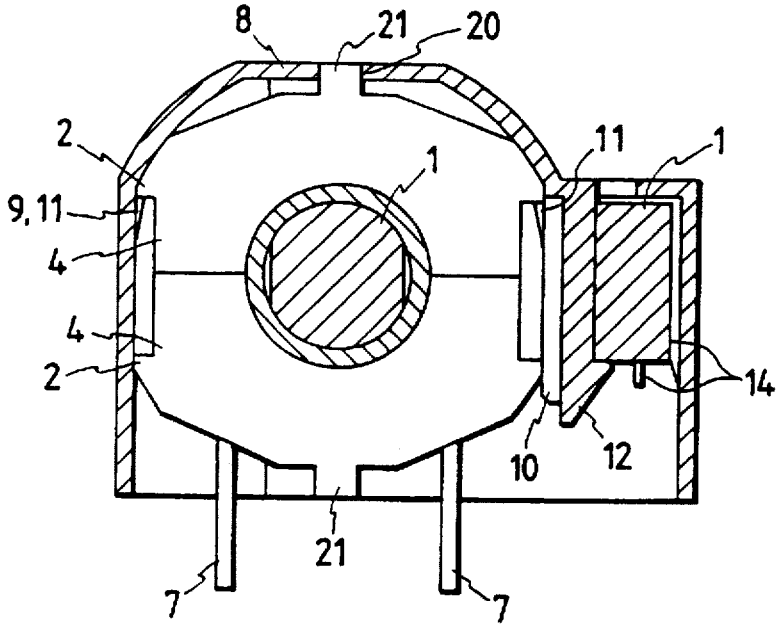
FIG. 27 is a sectional view of a line filter according to a ninth embodiment of this invention.
Figure 28:
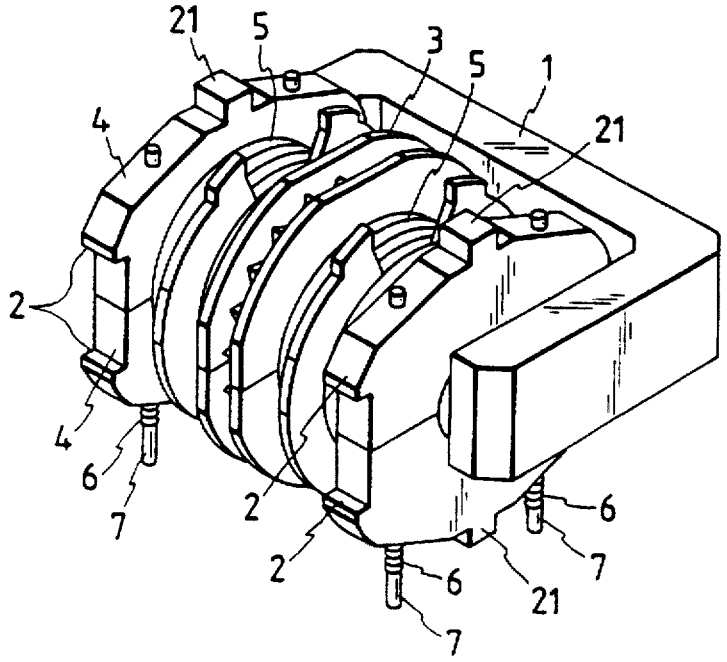
FIG. 28 is a perspective view of a magnetic core, a bobbin, and filter windings in the line filter of FIG. 27.
Figure 29:
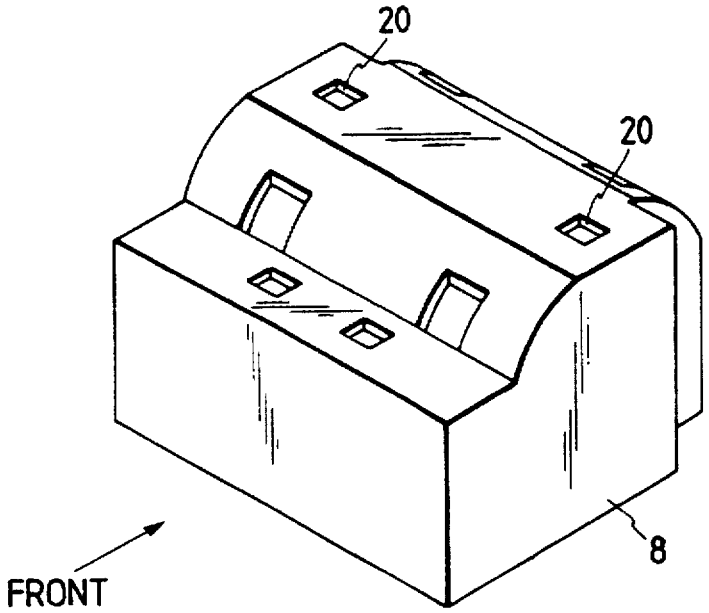
FIG. 29 is a perspective front side view of a casing in the line filter of FIG. 27.
Figure 30:
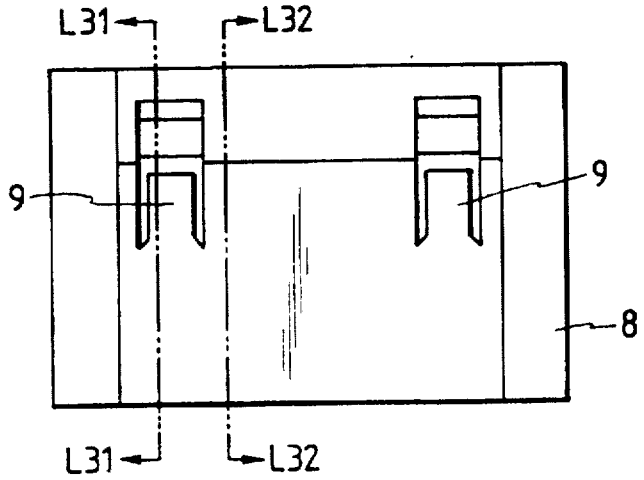
FIG. 30 is a rear view of the casing of FIG. 29.
Figure 31:
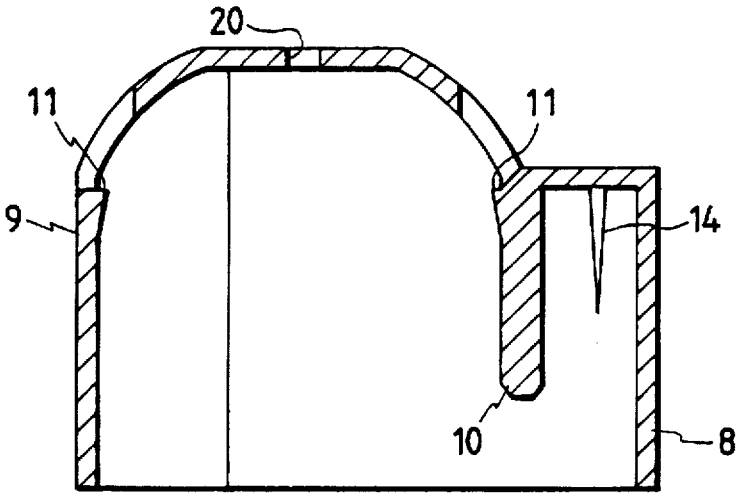
FIG. 31 is a sectional view of the casing taken along the line L31—L31 in FIG. 30.
Figure 32:
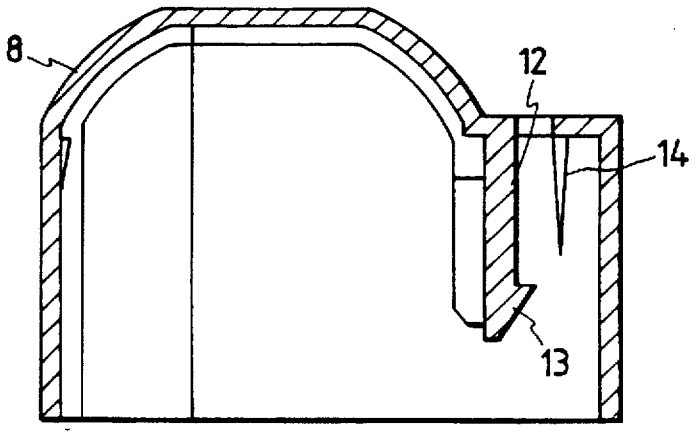
FIG. 32 is a sectional view of the casing taken along the line L32—L32 in FIG. 30.
Figure 33:
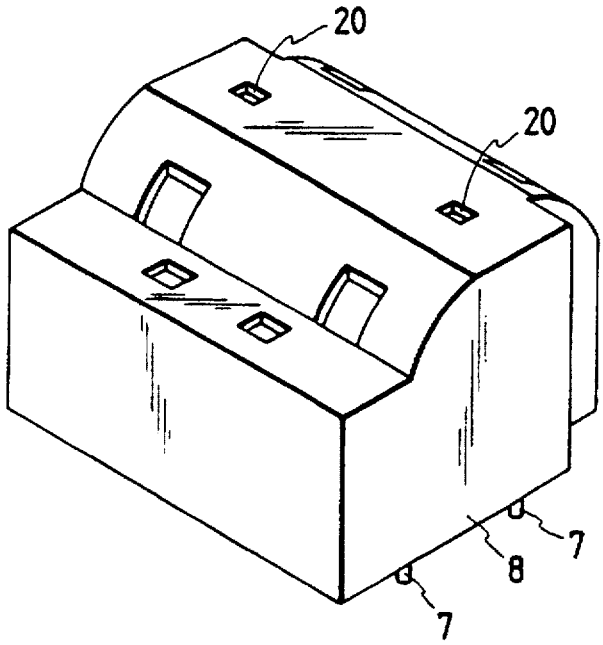
FIG. 33 is a perspective view of the line filter of FIG. 27.
Figure 34:
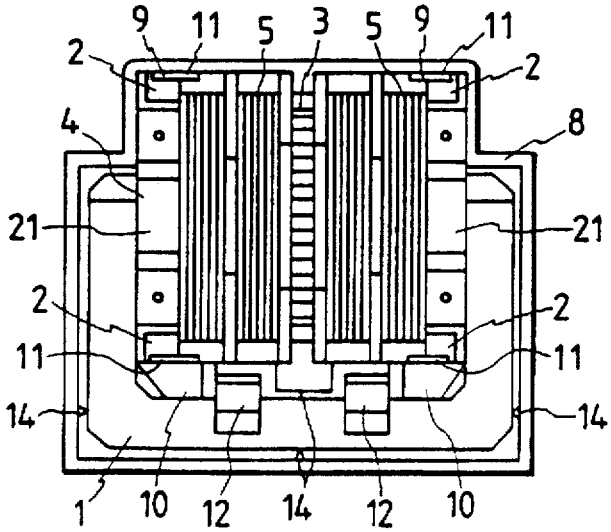
FIG. 34 is a bottom view of the line filter of FIG. 27.

FIGS. 20, 21, and 22 show a seventh embodiment of this invention which is similar to the embodiment of FIGS. 1–8 and 59 except for design changes indicated hereinafter. In the embodiment of FIGS. 20, 21, and 22, a casing 8 of a line filter has a plurality of radiating apertures 19 located above filter windings 5 on a bobbin 4 (see FIG. 2). The radiating apertures 19 facilitate escape of heat from the bobbin 4 through the casing 8.

DESCRIPTION OF THE EIGHTH PREFERRED EMBODIMENT

FIGS. 23, 24, 25, and 26 show an eighth embodiment of this invention which is similar to the embodiment of FIGS. 9–13 except for design changes indicated hereinafter. In the embodiment of FIGS. 23–26, a casing 15 of a line filter has a plurality of radiating apertures 19 located above filter windings 5 on a bobbin 4 (see FIG. 2). The radiating apertures 19 facilitate escape of heat from the bobbin 4 through the casing 15.

DESCRIPTION OF THE NINTH PREFERRED EMBODIMENT

FIGS. 27, 28, 29, 30, 31, 32, 33, and 34 show a ninth embodiment of this invention which is similar to the embodiment of FIGS. 1–8 and 59 except for design changes indicated hereinafter. In the embodiment of FIGS. 27–34, each of end collars of a bobbin 4 has a pair of diametrically opposed projections 21 of a rectangular cross-section. In addition, the upper walls of a casing 8 of a line filter have a pair of rectangular apertures 20 for accommodating two of the projections 21 on the bobbin 4.

During assembly of the line filter, the combination of a magnetic core 1, the bobbin 4, filter windings 5, and metal terminals 7 (see FIG. 2) is placed into the casing 8 via a bottom opening thereof. During movement of the combination into the casing 8, the two of the projections 21 on the bobbin 4 fit into the apertures 20 in the casing 8 respectively so that the bobbin 4 can be more rigidly fixed to the casing 8.

Each of the projections 21 on the bobbin 4 has a flat top surface. After assembly of the line filter has been completed, the projections 21 on the bobbin 4 which do not fit into the casing apertures 20 extend downward from the bobbin 4. The lowermost surfaces of these downward projections 21 are flush with the lowermost surfaces of the casing 8. When the line filter is mounted on a circuit board, this configuration enables stable support of the line filter on the circuit board since the lowermost surfaces of the casing 8 and the downward projections 21 abut against the upper surfaces of the circuit board.

DESCRIPTION OF THE TENTH PREFERRED EMBODIMENT

Figure 35:
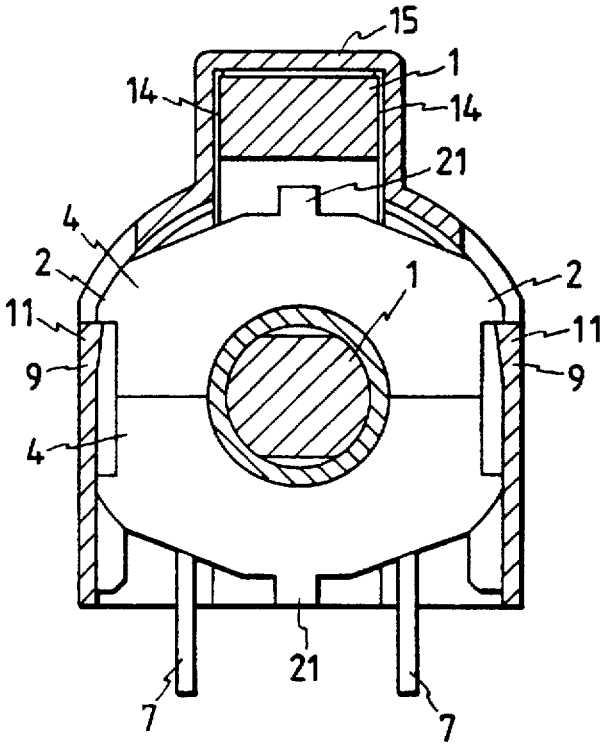
FIG. 35 is a sectional view of a line filter according to a tenth embodiment of this invention.

FIG. 35 shows a tenth embodiment of this invention which is similar to the embodiment of FIGS. 9–13 except for design changes indicated hereinafter. In the embodiment of FIG. 35, each of end collars of a bobbin 4 has a pair of diametrically opposed projections 21 of a rectangular cross-section. Each of the projections 21 on the bobbin 4 has a flat top surface. After assembly of a line filter has been completed two of the projections 21 extend downward from the bobbin 4. The lowermost surfaces of these downward projections 21 are flush with the lowermost surfaces of a casing 15. When the line filter is mounted on a circuit board, this configuration enables stable support of the line filter on the circuit board since the lowermost surfaces of the casing 15 and the downward projections 21 abut against the upper surfaces of the circuit board.

DESCRIPTION OF THE ELEVENTH PREFERRED EMBODIMENT

Figure 36:
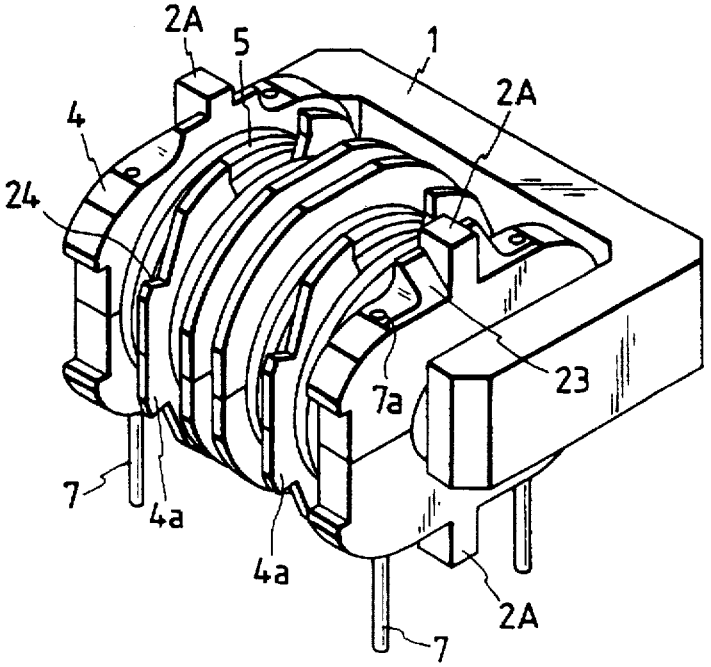
FIG. 36 is a perspective view of a line filter according to an eleventh embodiment of this invention.
Figure 37:
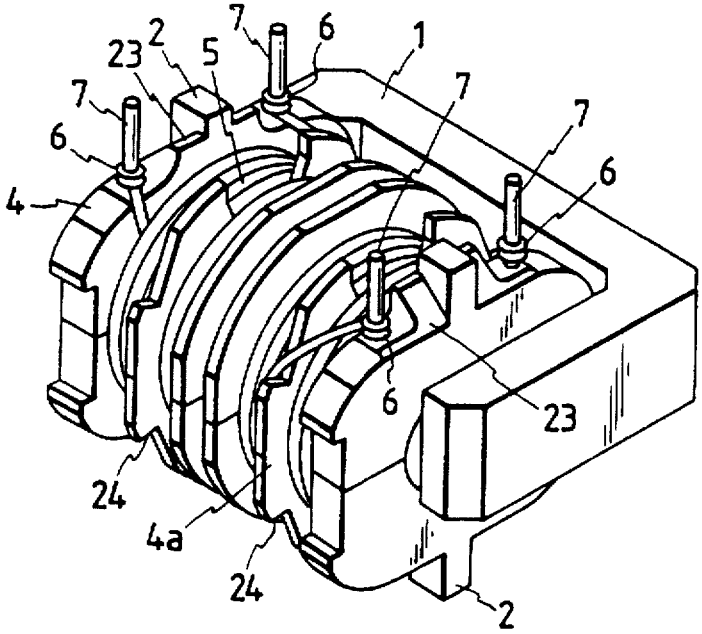
FIG. 37 is a perspective view of the line filter of FIG. 36.

As shown in FIGS. 36 and 37, a line filter includes a magnetic core 1 which has a rectangular closed-loop configuration with a single opening. The core 1 is made of high-permeability magnetic material such as ferrite. A cylindrical bobbin 4 is positioned around one leg of the magnetic core 1. The bobbin 4 has end collars each formed with a pair of diametrically opposed projections 2A. Each of the end collars of the bobbin 4 has holes 7*a* for accommodating metal terminals 7. In addition, each of the end collars of the bobbin 4 has taper portions 23 located between the projections 2A and ends of the holes 7*a*.

Figure 38:
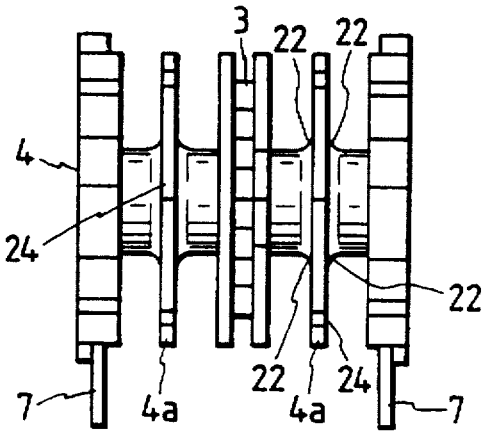
FIG. 38 is a front view of a bobbin in the line filter of FIG. 36.

As shown in FIGS. 36, 37, and 38, a central portion of the bobbin 4 is provided with a gear 3. The bobbin 4 is also provided with intermediate collars 4*a* extending between the gear 3 and the end collars thereof. Each of the intermediate collars 4*a* has grooves or cuts 24. As shown in FIG. 38, the bobbin 4 has "R" portions 22 extending along inner base regions of the intermediate collars 4*a*. The "R" portions 22 reinforce the intermediate collars 4*a*. Each of the "R" portions 22 has a curvature radius of about 0.2 to 0.5.

The bobbin 4 is divided into two semicylindrical molded halves made of resin. During assembly of the line filter, separate bobbin halves are placed around one leg of the magnetic core 1 and are then combined into a cylindrical bobbin rotatable about the leg of the magnetic core 1. The bobbin halves have engagement portions fittable to each other. When the bobbin halves are combined. The engagement portions of the bobbin halves are fitted to each other so that the bobbin halves can be secured to each other.

The bobbin 4 has two grooves for accommodating windings. During assembly of the line filter, ends of copper wires covered with insulating films are connected to the bobbin 4. Then, a suitable drive mechanism (not shown) is set into engagement with the gear 3 on the bobbin 4. As the bobbin 4 is rotated relative to the magnetic core 1 by the drive mechanism, the wires are automatically wound on the bobbin in equal circumferential directions to form two filter windings 5. After the w-ires have been successfully wound on the bobbin 4. Metal terminals 7 are fitted into the holes 7*a* in the bobbin collars so that the metal terminals 7 are secured to the bobbin 4. Leading ends 6 of the wires are wound on the metal terminals 7 respectively, and are then mechanically and electrically connected to the metal terminals 7 by, for example, solder. Trailing ends 6 of the wires are made into engagement with the intermediate collars 4*a* at the grooves 24, and are then wound on the metal terminals 7 respectively before they are mechanically and electrically connected to the metal terminals 7 by, for example, solder. Unnecessary remainders of the ends 6 of the wires are cut by a cutting member blade placed along the taper portions 23 on the end collars of the bobbin 4. At a last stage of the assembly of the line filter, the bobbin 4 and the magnetic core 1 may be bonded together by a suitable device or adhesive.

Soldering the ends 6 of the wires to the metal terminals 7 uses a solder bath in which the wire ends 6 and the metal terminals 7 are dipped in an inclined manner to prevent the taper portions 23 on the end collars of the bobbin 4 from contacting solder. During the soldering process, the projections 2A on the end collars of the bobbin 4 enable escape of solder.

The filter windings 5, the metal terminals 7, and the connections therebetween may also be provided as follows. Before the execution of a process of winding the copper wires on the bobbin 4, the metal terminals 7 are inserted into the respective holes 7*a* in the bobbin collars to an extent such that portions of the metal terminals 7 which emerge from outer surfaces of the bobbin collars will not interfere with rotation of the bobbin 4 relative to the magnetic core 1. Then, the process of winding the copper wires on the bobbin 4 to form the filter windings 5 is executed while the bobbin 4 is rotated relative to the magnetic core 1. After the wires have been successfully wound on the bobbin 4, the metal terminals 7 are shifted relative to the bobbin collars by a desired distance. Subsequently, opposite ends 6 of the wires are wound on the metal terminals 7 respectively, and are mechanically and electrically connected to the metal terminals 7 by, for example, solder.

DESCRIPTION OF THE TWELFTH PREFERRED EMBODIMENT

Figure 39:
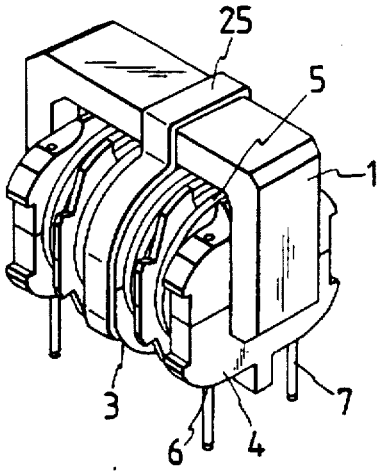
FIG. 39 is a perspective view of a line filter according to a twelfth embodiment of this invention.

FIG. 39 shows a twelfth embodiment of this invention which is similar to the embodiment of FIGS. 36–38 except for design changes indicated hereinafter. A line filter according to the embodiment of FIG. 39 is of a vertical type. In the embodiment of FIG. 39, a magnetic core 1 and a bobbin 4 are fixed to each other by a flexible core band 25 made of synthetic resin.

Figure 40:
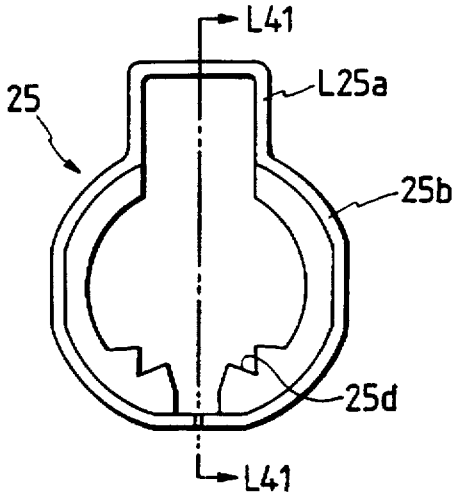
FIG. 40 is a front view of a core band in the line filter of FIG. 39.
Figure 41:
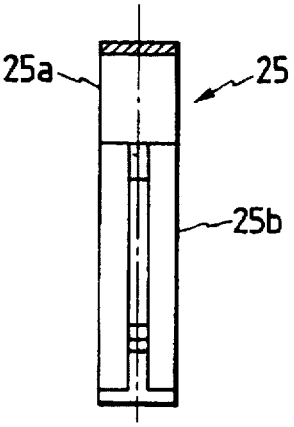
FIG. 41 is a sectional view of the core band taken along the line L41—L41 in FIG. 40.
Figure 42:
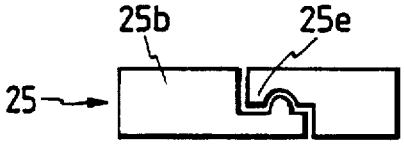
FIG. 42 is a bottom view of the core band of FIG. 40.

As shown in FIGS. 40, 41, and 42, the core band 25 has a U-shaped portion 25*a* for retaining the core 1, and a circular portion 25*b* for retaining the bobbin 4. The core retaining portion 25*a* and the bobbin retaining portion 25*b* are integral with each other. The core retaining portion 25*a* has inside dimensions corresponding to outside dimensions of a leg of the magnetic core 1 so that the core retaining portion 25*a* can fit on the leg of the magnetic core 1. The bobbin retaining portion 25*b* has engagement teeth 25*d* opposing the core retaining portion 25*a*. The bobbin retaining portion 25*b* has a width approximately equal to the distance between end collars of a gear 3 on the bobbin 4 so that the bobbin retaining portion 25*b* can fit into a region between the end collars of the gear 3. The engagement teeth 25*d* on the bobbin retaining portion 25*b* can mesh with the teeth of the gear 3 on the bobbin 4. The core band 25 has a hook 25*e* composed of a pair of hooking members engageable with each other. The core band 25 is closed into a loop by connecting the hooking members of the hook 25*e* to each other. The core band 25 is opened by disconnecting the hooking members of the hook 25*e* from each other.

After assembly of the magnetic core 1, the bobbin 4, filter windings 5, and metal terminals 7 has been completed. The open core band 25 is placed around the combination of the magnetic core 1 and the bobbin 4. Specifically, the core retaining portion 25*a* of the core band 25 is fitted on a leg of the magnetic core 1 while the bobbin retaining portion 25*b* of the core band 25 is fitted into the gear 3 on the bobbin 4. At this time, the engagement teeth 25*d* on the bobbin retaining portion 25*b* of the core band 25 mesh with the teeth of the gear 3 on the bobbin 4. Then, the hooking members of the hook 25*e* of the core band 25 are connected so that the magnetic core 1 and the bobbin 4 are fixed to each other by the core band 25.

DESCRIPTION OF THE THIRTEENTH PREFERRED EMBODIMENT

Figure 43:
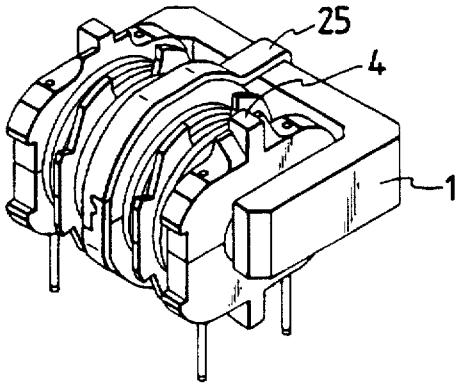
FIG. 43 is a perspective view of a line filter according to a thirteenth embodiment of this invention.

FIG. 43 shows a thirteenth embodiment of this invention which is similar to the embodiment of FIGS. 39–42 except for design changes indicated hereinafter. In the embodiment of FIG. 43, the angular positions of a magnetic core 1 and a core band 25 relative to a bobbin 4 are changed from those in the embodiment of FIGS. 39–42 so that a line filter is of a horizontal type.

DESCRIPTION OF THE FOURTEENTH PREFERRED EMBODIMENT

Figure 44:
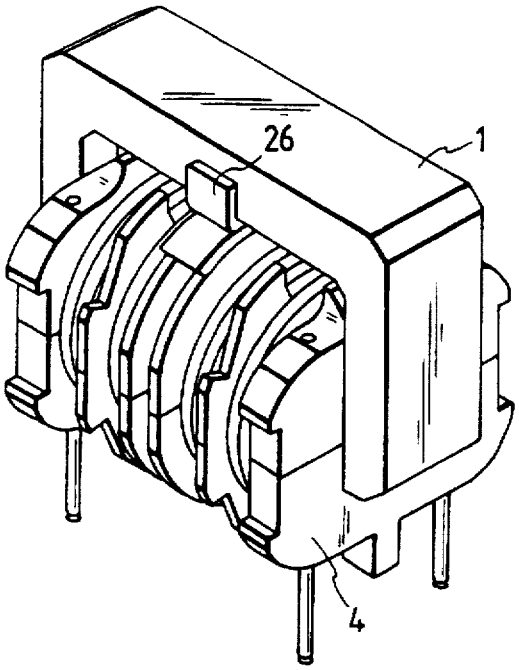
FIG. 44 is a perspective view of a line filter according to a fourteenth embodiment of this invention.

FIG. 44 shows a fourteenth embodiment of this invention which is similar to the embodiment of FIGS. 36–38 except for design changes indicated hereinafter. A line filter according to the embodiment of FIG. 44 is of a vertical type. In the embodiment of FIG. 44, a magnetic core 1 and a bobbin 4 are fixed to each other by a core fixing member 26 made of flexible synthetic resin.

Figure 45:
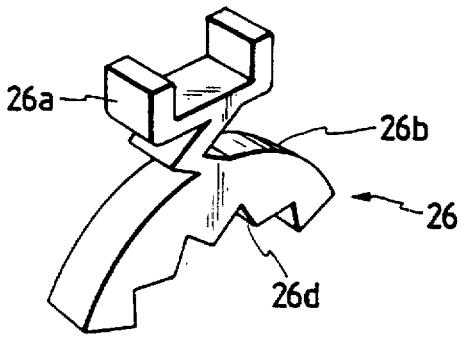
FIG. 45 is a perspective view of a core fixing member in the line filter of FIG. 44.

As shown in FIG. 45, the core fixing member 26 has a U-shaped portion 26*a* for retaining the core 1, and an arcuate portion 26*b* for retaining the bobbin 4. The core retaining portion 26*a* and the bobbin retaining portion 26*b* are integral with each other. The core retaining portion 26*a* has inside dimensions corresponding to outside dimensions of a leg of the magnetic core 1 so that the core retaining portion 26*a* can fit on the leg of the magnetic core 1. The bobbin retaining portion 26*b* has engagement teeth 26*d*. The bobbin retaining portion 26*b* has a width approximately equal to the distance between end collars of a gear 3 on the bobbin 4 so that the bobbin retaining portion 26*b* can fit into a region between the end collars of the gear 3. The engagement teeth 26*d* on the bobbin retaining portion 26*b* can mesh with the teeth of the gear 3 on the bobbin 4.

After assembly of the magnetic core 1, the bobbin 4, filter windings 5, and metal terminals 7 has been completed, the core fixing member 26 is forced and placed between the leg of the magnetic core 1 and the bobbin 4. Specifically, the core retaining portion 26*a* of the core fixing member 26 is fitted on the leg of the magnetic core 1 while the bobbin retaining portion 26*b* of the core fixing member 26 is fitted into the gear 3 on the bobbin 4. At this time, the engagement teeth 26*d* on the bobbin retaining portion 26*b* of the core flying member 26 mesh with the teeth of the gear 3 on the bobbin 4. As a result, the magnetic core 1 and the bobbin 4 are fixed to each other by the core fixing member 26.

DESCRIPTION OF THE FIFTEENTH PREFERRED EMBODIMENT

Figure 46:
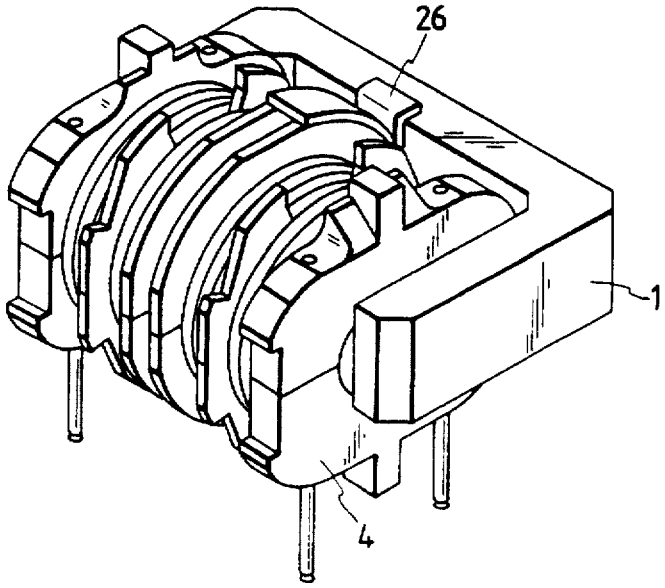
FIG. 46 is a perspective view of a line filter according to a fifteenth embodiment of this invention.

FIG. 46 shows a fifteenth embodiment of this invention which is similar to the embodiment of FIGS. 44 and 45 except for design changes indicated hereinafter. In the embodiment of FIG. 46, the angular positions of a magnetic core 1 and a core fixing member 26 relative to a bobbin 4 are changed from those in the embodiment of FIGS. 44 and 45 so that a line filter is of a horizontal type.

DESCRIPTION OF THE SIXTEENTH PREFERRED EMBODIMENT

Figure 47:
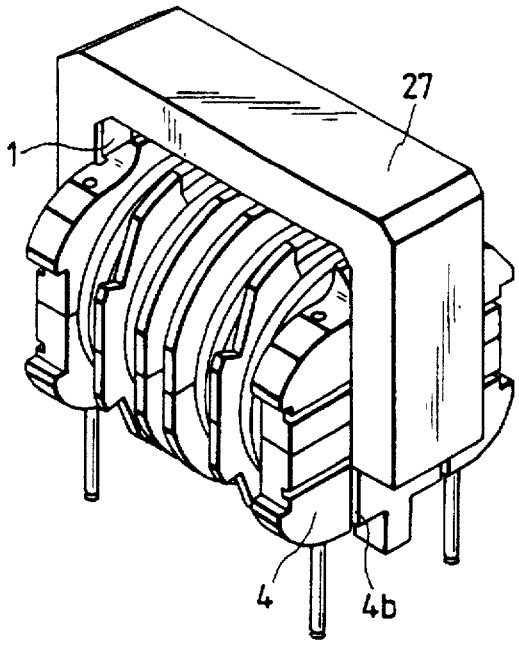
FIG. 47 is a perspective view of a line filter according to a sixteenth embodiment of this invention.

FIG. 47 shows a sixteenth embodiment of this invention which is similar to the embodiment of FIGS. 36–38 except for design changes indicated hereinafter. A line filter according to the embodiment of FIG. 47 is of a vertical type. In the embodiment of FIG. 47, a magnetic core 1 and a bobbin 4 are faced to each other by a core fixing member 27.

Figure 48:
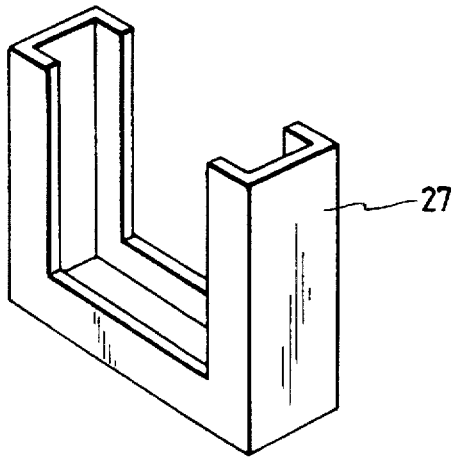
FIG. 48 is a perspective view of a core fixing member in the line filter of FIG. 47.

As shown in FIGS. 47 and 48, the core fixing member 27 has a U-shaped configuration corresponding to the configuration of the combination of a leg and yokes of the magnetic core 1. The core fixing member 27 has recesses for accommodating the leg and the yokes of the magnetic core 1. Outer faces of end collars of the bobbin 4 have parallel grooves 4*b* into which inner edges of arms of the core fixing member 27 can fit.

After assembly of the magnetic core 1, the bobbin 4, filter windings 5, and metal terminals 7 has been completed, the core fixing member 27 is forced and placed around the leg and the yokes of the magnetic core 1 while the inner edges of the arms of the core fixing member 27 are fitted into the grooves 4*b* in the outer faces of the end collars of the bobbin 4. As a result, the magnetic core 1 and the bobbin 4 are fixed to each other by the core fixing member 27.

DESCRIPTION OF THE SEVENTEENTH PREFERRED EMBODIMENT

Figure 49:
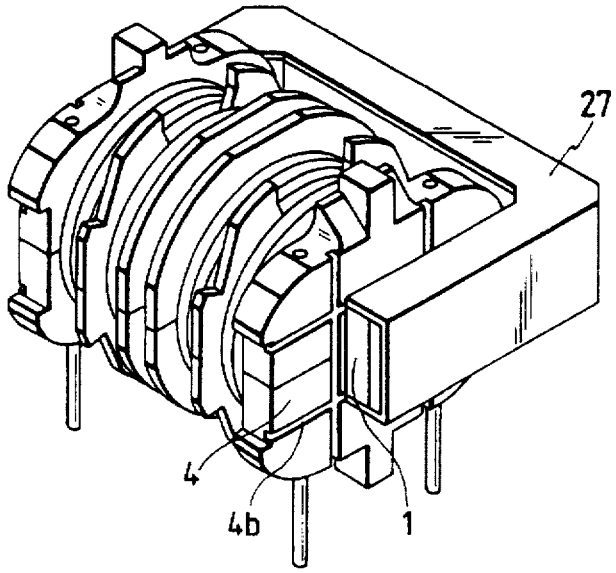
FIG. 49 is a perspective view of a line filter according to a seventeenth embodiment of this invention.

FIG. 49 shows a seventeenth embodiment of this invention which is similar to the embodiment of FIGS. 47 and 48 except for design changes indicated hereinafter. In the embodiment of FIG. 49, the angular positions of a magnetic core 1 and a core fixing member 27 relative to a bobbin 4 are changed from those in the embodiment of FIGS. 47 and 48 so that a line filter is of a horizontal type.

DESCRIPTION OF THE EIGHTEENTH PREFERRED EMBODIMENT

Figure 50:
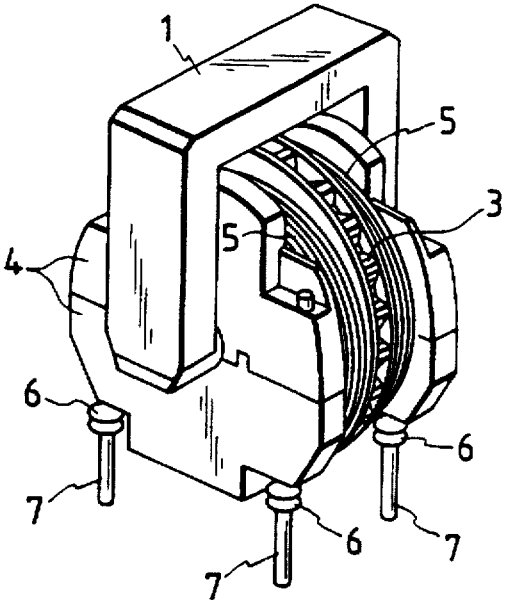
FIG. 50 is a perspective view of a magnetic core, a bobbin, and filter windings in a line filter according to an eighteenth embodiment of this invention.
Figure 51:
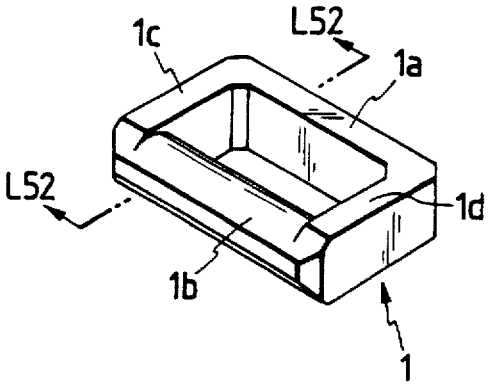
FIG. 51 is a perspective view of the magnetic core of FIG. 50.
Figure 52:
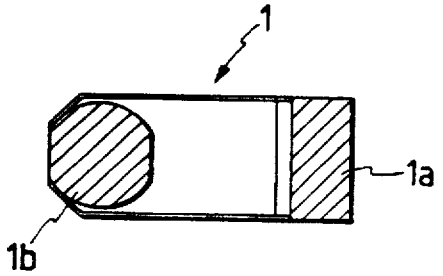
FIG. 52 is a sectional view of the magnetic core taken along the line L52—L52 in FIG. 51.

As shown in FIG. 50, a line filter includes a magnetic core 1. As shown in FIGS. 51 and 52, the magnetic core 1 has a rectangular closed-loop configuration with a single opening. Specifically, the magnetic core 1 has a pair of opposing legs 1*a* and 1*b*, and a pair of opposing yokes 1*c* and 1*d* connecting the legs 1*a* and 1*b*. The legs 1*a* and 1*b*, and the yokes 1*c* and 1*d* are integral with each other. The leg 1*a* and the yokes 1*c* and 1*d* have a rectangular cross-section and a uniform thickness. The leg 1*b* has an approximately circular cross-section. The cross-sectional area of the leg 1*b* is approximately equal to the cross-sectional area of the leg 1*a* and the yokes 1*c* and *d*. The leg 1*b* has a thickness smaller than the thickness of the leg 1*a* and the yokes 1*c* and 1*d*. The core 1 is made of high-permeability magnetic material such as ferrite.

Figure 53:
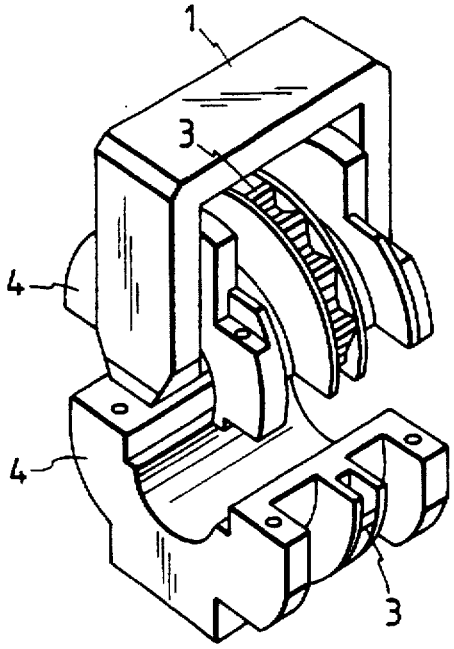
FIG. 53 is an exploded perspective view of the magnetic core and the bobbin of FIG. 50.
Figure 54:
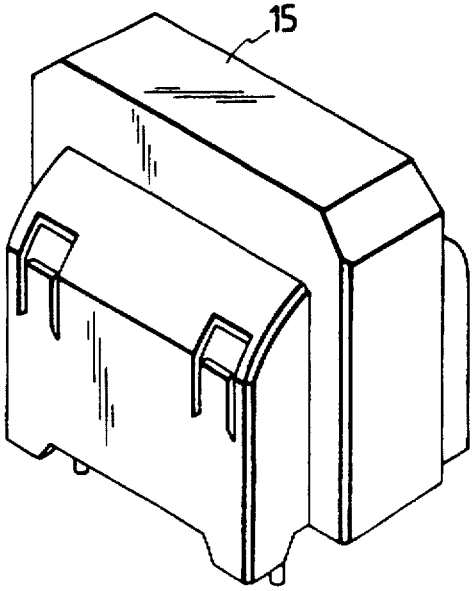
FIG. 54 is a perspective view of a casing in the line filter of the eighteenth embodiment.

As shown in FIG. 50, a cylindrical bobbin 4 is positioned around the leg 1*b* of the magnetic core. A central portion of the bobbin 4 is provided with a gear 3. As shown in FIG. 53, the bobbin 4 is divided into two semicylindrical molded halves made of resin. During assembly of the line filter, separate bobbin halves are placed around the leg 1*b* of the magnetic core 1 and are then combined into a cylindrical bobbin rotatable about the leg 1*b* of the magnetic core 1. The bobbin halves have engagement portions fittable to each other. When the bobbin halves are combined, the engagement portions of the bobbin halves are fitted to each other so that the bobbin halves can be secured to each other.

The bobbin 4 has two grooves for accommodating windings. During assembly of the line filter, ends of copper wires covered with insulating films are connected to the bobbin 4. Then, a suitable drive mechanism (not shown) is set into engagement with the gear 3 on the bobbin 4. As the bobbin 4 is rotated relative to the magnetic core 1 by the drive mechanism, the wires are automatically wound on the bobbin in equal circumferential directions to form two filter windings 5. End collars of the bobbin 4 have holes extending therethrough. After the wires have been successfully wound on the bobbin 4. Metal terminals 7 are fitted into the respective holes in the bobbin collars so that the metal terminals 7 are secured to the bobbin 4. Opposite ends 6 of the wires are wound on the metal terminals 7 respectively, and are mechanically and electrically connected to the metal terminals 7 by, for example solder.

The filter windings 5, the metal terminals 7 and the connections therebetween may also be provided as follows. Before the execution of a process of winding the copper wires on the bobbin 4, the metal terminals 7 are inserted into the respective holes in the bobbin collars to an extent such that portions of the metal terminals 7 which emerge from outer surfaces of the bobbin collars will not interfere with rotation of the bobbin 4 relative to the magnetic core 1. Then, the process of winding the copper wires on the bobbin 4 to form the filter windings 5 is executed while the bobbin 4 is rotated relative to the magnetic core 1. After the wires have been successfully wound on the bobbin 4, the metal terminals 7 are shifted relative to the bobbin collars by a desired distance. Subsequently, opposite ends 6 of the wires are wound on the metal terminals 7 respectively, and are mechanically and electrically connected to the metal terminals 7 by, for example, solder.

During assembly of the line filter, the combination of the magnetic core 1, the bobbin 4, the filter windings 5, and the metal terminals 7 is placed into and fixed to a molded casing 15 via a bottom opening thereof. The casing 15 is made of resin.

The casing 15 may be omitted. In this case, the magnetic core 1 and the bobbin 4 are bonded together by a suitable device or adhesive.

DESCRIPTION OF THE NINETEENTH PREFERRED EMBODIMENT

A nineteenth embodiment of this invention is similar to the embodiment of FIGS. 50–54 except for design changes indicated hereinafter. The nineteenth embodiment includes a magnetic core 1 modified from that in the embodiment of FIGS. 50–54.

Figure 55:
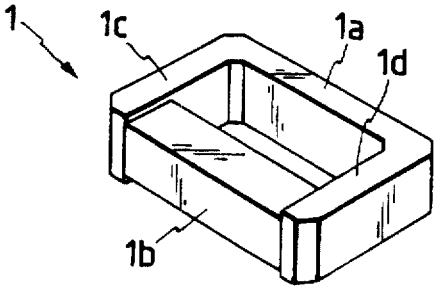
FIG. 55 is a perspective view of a magnetic core in a line filter according to a nineteenth embodiment of this invention.

As shown in FIG. 55, the magnetic core 1 in the nineteenth embodiment has a rectangular closed-loop configuration with a single opening. Specifically, the magnetic core 1 has a pair of opposing legs 1*a* and 1*b*, and a pair of opposing yokes 1*c* and 1*d* connecting the legs 1*a* and 1*b*. The legs 1*a* and 1*b*, and the yokes 1*c* arid 1*d* are integral with each other. The leg 1*a* and the yokes 1*c* and 1*d* have a rectangular cross-section and a uniform thickness. The leg 1*b* has a rectangular cross-section. The cross-sectional area of the leg 1*b* is approximately equal to the cross-sectional area of the leg 1*a* and the yokes 1*c* and 1*d*. The leg 1*b* has a thickness smaller than the thickness of the leg 1*a* and the yokes 1*c* and 1*d*. The core 1 is made of high-permeability magnetic material such as ferrite. A cylindrical bobbin is positioned around the leg 1*b* of the magnetic core 1.

DESCRIPTION OF THE TWENTIETH PREFERRED EMBODIMENT

Figure 56:
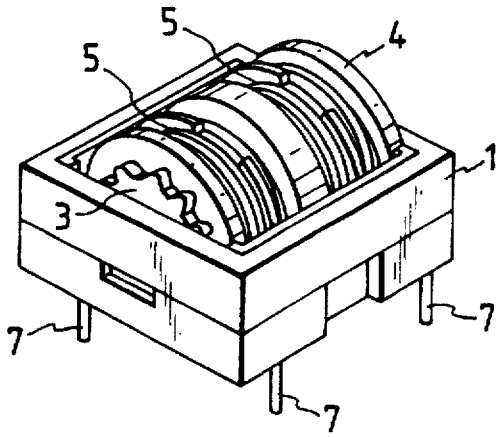
FIG. 56 is a perspective view of a line filter according to a twentieth embodiment of this invention.
Figure 57:
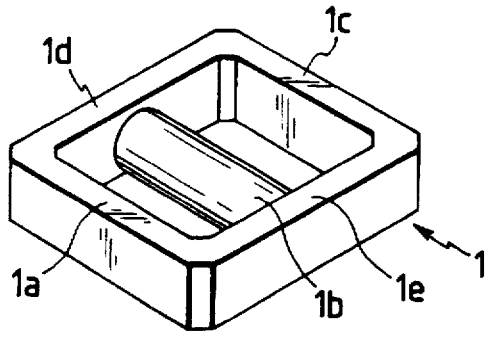
FIG. 57 is a perspective view of a magnetic core in the line filter of FIG. 56.

As shown in FIG. 56, a line filter includes a magnetic core 1. As shown in FIG. 57, the magnetic core 1 has a shape of a character "□". In other words, the magnetic core 1 has a rectangular configuration with two openings. Specifically, the magnetic core 1 has a central leg 1*b*, two side legs 1*a* and 1*c*, and two yokes 1*d* and 1*e* connecting the legs 1*a*, 1*b*, and 1*c*. The legs 1*a*, 1*b* and 1*c*, and the yokes 1*d* and 1*e* are integral with each other. The side legs 1*a* and 1*c*, and the yokes 1*d* and 1*e* have a rectangular cross-section and a uniform thickness. The central leg 1*b* has an approximately circular cross-section. The cross-sectional area of the central leg 1*b* is approximately equal to twice the cross-sectional area of the side legs 1*a* and 1*c*, and the yokes 1*d* and 1*e*. The central leg 1*b* has a thickness smaller than the thickness of the side legs 1*a* and 1*c*, and the yokes 1*d* and 1*e*. The core 1 is made of high-permeability magnetic material such as ferrite.

As shown in FIG. 56, a cylindrical bobbin 4 is positioned around the central leg 1*b* of the magnetic core 1. An end of the bobbin 4 is provided with a gear 3. The bobbin 4 is divided into two semicylindrical molded halves made of resin. During assembly of the line filter separate bobbin halves are placed around the central leg 1*b* of the magnetic core 1 and are then combined into a cylindrical bobbin rotatable about the central leg 1*b* of the magnetic core 1. The bobbin halves have engagement portions fittable to each other. When the bobbin halves are combined, the engagement portions of the bobbin halves are fitted to each other so that the bobbin halves can be secured to each other.

The bobbin 4 has two grooves for accommodating windings. During assembly of the line filter, ends of copper wires covered with insulating films are connected to the bobbin 4. Then, a suitable drive mechanism (not shown) is set into engagement with the gear 3 on the bobbin 4. As the bobbin 4 is rotated relative to the magnetic core 1 by the drive mechanism, the wires are automatically wound on the bobbin in equal circumferential directions to form two filter windings 5. After the wires have been successfully wound on the bobbin 4, opposite ends of the wires are wound on metal terminals 7 respectively and are mechanically and electrically connected to the metal terminals 7 by, for example, solder. At a final stage of the assembly of the line filter, the magnetic core 1 and the bobbin 4 are bonded together by a suitable device or adhesive.

DESCRIPTION OF THE TWENTY-FIRST PREFERRED EMBODIMENT

A twenty-first embodiment of this invention is similar to the embodiment of FIGS. 56 and 57 except for design changes indicated hereinafter. The twenty-first embodiment includes a magnetic core 1 modified from that in the embodiment of FIGS. 56 and 57.

Figure 58:
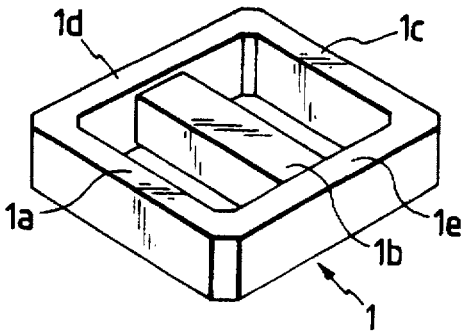
FIG. 58 is a perspective view of a magnetic core in a line filter according to a twenty-first embodiment of this invention.

As shown in FIG. 58, the magnetic core 1 in the twenty-first embodiment has a shape of a character "□". Specifically, the magnetic core 1 has a central leg 1*b*, two side legs 1*a* and 1*c*, and two yokes 1*d* and 1*e* connecting the legs 1*a*, 1*b*, and 1*c*. The legs 1*a*, 1*b* and 1*c* and the yokes 1*d* and 1*e* are integral with each other. The side legs 1*a* and 1*c*, and the yokes 1*d* and 1*e* have a rectangular cross-section and a uniform thickness. The central leg 1*b* has a rectangular cross-section. The cross-sectional area of the central leg 1*b* is approximately equal to twice the cross-sectional area of the side legs 1*a* and 1*c*, and the yokes 1*d* and 1*e*. The central leg 1*b* has a thickness smaller than the thickness of the side legs 1*a* and 1*c*, and the yokes 1*d* and 1*e*. The core 1 is made of high-permeability magnetic material such as ferrite. A cylindrical bobbin 4 is positioned around the central leg 1*b* of the magnetic core 1.

What is claimed is:

1. A line filter comprising:

a magnetic core having a leg;

a bobbin placed around the leg of the magnetic core and having a gear;

a pair of windings provided on the bobbin; and a band engaging the gear and the magnetic core to fix the gear and the magnetic core to each other.

* * * * *